US008684228B2

(12) United States Patent
Parker

(10) Patent No.: US 8,684,228 B2
(45) Date of Patent: Apr. 1, 2014

(54) SANITIZING WIPE DISPENSING SYSTEM

(75) Inventor: Kimberly A Parker, Minneapolis, MN (US)

(73) Assignee: Handago, LLC, Minneapolis, MN (US)

( * ) Notice: Subject to any disclaimer, the term of this patent is extended or adjusted under 35 U.S.C. 154(b) by 987 days.

(21) Appl. No.: 12/380,481

(22) Filed: Feb. 27, 2009

(65) Prior Publication Data

US 2010/0163569 A1 Jul. 1, 2010

Related U.S. Application Data

(63) Continuation-in-part of application No. 11/168,098, filed on Jun. 28, 2005, now abandoned.

(51) Int. Cl.
*A47K 10/24* (2006.01)

(52) U.S. Cl.
USPC ..... 221/283; 221/45; 221/199; 221/282; 221/92

(58) Field of Classification Search
USPC ..... 221/45, 92, 199, 282, 283
See application file for complete search history.

(56) References Cited

U.S. PATENT DOCUMENTS

| | | | | |
|---|---|---|---|---|
| 1,681,840 | A | 8/1928 | Carlson | |
| 1,688,242 | A | 10/1928 | Lawrence et al. | |
| 1,994,394 | A | 3/1935 | Horwitt | |
| 2,415,588 | A | 2/1947 | Gui | |
| 3,072,245 | A | 1/1963 | Faltin | |
| 3,573,879 | A * | 4/1971 | Bergkamp et al. | 280/47.19 |
| 4,143,792 | A | 3/1979 | Rex | |
| 4,165,138 | A * | 8/1979 | Hedge et al. | 242/560 |
| 4,644,689 | A | 2/1987 | Arians | |
| 4,788,909 | A | 12/1988 | Stewart | |
| 5,244,220 | A * | 9/1993 | Cortez | 280/47.26 |
| 5,687,875 | A | 11/1997 | Watts et al. | |
| 5,753,246 | A | 5/1998 | Peters | |
| 6,508,383 | B2 | 1/2003 | Lidahl et al. | |
| 6,540,103 | B2 | 4/2003 | Silvers | |
| 6,578,730 | B2 | 6/2003 | Trunsky | |
| 6,691,897 | B2 | 2/2004 | Ashe | |
| 6,702,147 | B2 | 3/2004 | Ashford | |
| 6,827,357 | B2 * | 12/2004 | Calmeise et al. | 280/47.34 |
| 6,903,307 | B1 * | 6/2005 | McConnell et al. | 219/401 |
| 6,905,039 | B2 | 6/2005 | Richter et al. | |
| 6,959,890 | B1 * | 11/2005 | Breitinger | 242/592 |
| 7,204,389 | B2 | 4/2007 | Smith | |
| 7,222,747 | B1 * | 5/2007 | Savran | 221/34 |

(Continued)

OTHER PUBLICATIONS

2XL Corp. www.2xlcorp.com "Gym Wipes" Mar. 25, 2004.

*Primary Examiner* — Michael K Collins
(74) *Attorney, Agent, or Firm* — Joseph S. Heino; Patrick M. Bergin

(57) ABSTRACT

The present invention provides for a mobile and self-contained sanitizing wipe dispensing system that dispenses discreet sheets of sanitizing wipes for hand or surface sanitization. The system is configured to facilitate the consistent dispensing of individual wipes, preferably from a roll of perforated but attached wipes, such that each wipe is separated at the point of perforation and the leading edge of the following sheet for easy access of each successive wipe. Means are provided to dispense wipes from a wall that is incorporated into the system, a plurality of walls forming an enclosure. The enclosure functions as a storage device for its own wipe refills and provides an integrated receptacle for used wipes. One embodiment comprises walls that are like-configured for ease in production and assembly and for reducing the cost of production.

8 Claims, 24 Drawing Sheets

(56) References Cited

U.S. PATENT DOCUMENTS

| | | | | |
|---|---|---|---|---|
| 7,296,705 | B2 * | 11/2007 | Boulet-Mazer | 221/46 |
| 2002/0190073 | A1 | 12/2002 | Hewett | |
| 2006/0208130 | A1 | 9/2006 | Castor et al. | |
| 2006/0289557 | A1 | 12/2006 | Mitchell et al. | |
| 2006/0289558 | A1 | 12/2006 | Parker | |
| 2008/0012257 | A1 | 1/2008 | Cregg | |
| 2008/0289993 | A1 * | 11/2008 | Flannery | 206/581 |
| 2009/0223993 | A1 * | 9/2009 | Lorenzati | 221/35 |
| 2010/0163569 | A1 * | 7/2010 | Parker | 221/1 |

* cited by examiner

SANITIZING WIPE DISPENSING SYSTEM

CROSS-REFERENCE TO RELATED APPLICATIONS

This application is a continuation-in-part of U.S. Ser. No. 11/168,098 filed on Jun. 28, 2005, now abandoned which is hereby incorporated by reference in its entirety.

FIELD OF THE INVENTION

This invention relates to the sanitation of hands and surfaces to control the spread of germs. More specifically, it relates to a mobile and self-contained sanitizing wipe dispensing system that dispenses discreet sheets of sanitizing wipes while exposing the leading edge of each following sheet, functions as a storage device for its own wipe refills, and provides an integrated receptacle for used wipes.

BACKGROUND OF THE INVENTION

Cleanliness is a crucial aspect of personal and public health. While sanitation systems have improved, the presence of bacteria, viruses, and other germs still cause diseases in people worldwide. For example, the common cold virus can be spread between people by hand-to-hand contact, or picked up from surfaces on which the virus exists. The Rota virus germ that causes gastrointestinal illness can be transferred from a dry smooth surface to a clean hand for as long as 20 minutes after the surface has been contaminated. Severe Acute Respiratory Syndrome ("SARS"), hepatitis A, meningitis, and infectious diarrhea are other common prevalent health problems.

Unfortunately, many people fail to wash their hands in public places, thereby exposing themselves to the germs that cause these illnesses by rubbing their nose or eyes after touching someone or something contaminated with the bacteria or virus. Moreover, such people can transfer this risk of infection to others since most such bacteria and viruses can be transferred by hand-to-hand contact.

Despite the proven health benefits of good hand hygiene, many people simply do not bother to wash their hands, or do so incorrectly. The bathrooms in restaurants can suffer from long lines, thereby discouraging people from taking the time to wash their hands before eating. Moreover, many food courts at malls have eliminated their restroom facilities in order to save the need to clean them. In such situations, people have nowhere to go to wash their hands. However, even in cases where people do stop to wash their hands before eating, there may be a failure to wet the hands, followed by thorough lathering of the hands with soap, so that the surfactants contained in the soap can attach themselves to the germs and dirt particles to suspend them within the hot or warm rinse water that is necessary to eliminate the harmful germs and dirt from the hands.

For those people who take the time and trouble to clean their hands with soap and water, dry paper towels are typically available in dispensers located in public bathrooms near the sink. The towels can be used to dry their hands with a trash receptacle close by for disposal of the used paper towel. U.S. Pat. No. 1,688,242 issued to Lawrence et al.; U.S. Pat. No. 2,415,588 issued to Gui; U.S. Pat. No. 1,994,394 issued to Horwitt; and U.S. Pat. No. 1,681,840 issued to Carlson disclose typical paper towel and waste basket arrangements. U.S. Pat. No. 4,788,909 issued to Stewart improves upon this simple concept by providing a wall-mounted paper towel dispenser and wastebasket whereby the person needs to step on a pedal to advance the next paper towel, which also activates a tamper in the wastebasket that compacts the volume of used towels to reduce the incidence of overflowing wastebaskets.

U.S. Pat. No. 4,644,689 issued to Arians addresses concerns over germs that might breed on the door knobs of public bathrooms. Therefore, it discloses an arrangement consisting of a paper towel dispenser located immediately above the door handle and a trash receptacle positioned immediately below the door handle. In this manner, the person who wishes to exit the bathroom can grab a paper towel and use it to grab the door handle to open the door, letting the towel drop in the trash receptacle when he releases the door handle as he walks through the open door. Of course, such a towel dispenser does nothing for cleaning the hands or killing the germs on the door handle.

U.S. Published Application 2002/0190073 filed by Hewett discloses a personal dispenser that is mounted to a bathroom wall within a private household shower, bathtub, sauna, or steam room. It provides dry tissues to a person to clear mucus out of his or her nasal passages to take advantage of moist environments within the bathroom when "nasal passages are more susceptible to such clearings." A removable receptacle is attached to the dispenser for receiving the used tissue. A second optional dispenser provides towelettes that can be impregnated with fragrances or medical products for use in removing makeup.

Pre-moistened and disposable towelettes impregnated with a cleaning and/or disinfectant solution have now become increasingly popular in the marketplace for sanitizing one's hands and other surfaces, and are often called "wet wipes" or simply "wipes." Accordingly, similar efforts have been made to provide dispensers for cleaning wet wipes. For example, U.S. Pat. No. 6,540,103 issued to Silvers illustrates a multiple-compartment bin that would be located on the floor of, for example, a home nursery or day care facility that contains new diapers, baby wipes, and a sealed receptacle for disposing of the used diapers. The wipes are stacked in a sealed compartment to keep them clean and slow down the evaporation of the cleaning solution contained in the wipes. A sanitation kit for placement on a table or counter is disclosed in U.S. Pat. No. 5,753,246 issued to Peters consisting of a container for a stack of germicidal towelettes hermetically sealed in envelopes, and a disposal bin attached to the towelette container. Similarly, U.S. Pat. No. 6,702,147 issued to Ashford shows a "Bedside Butler" unit for a hotel or home nightstand table that constitutes a box with two containers—one container with a sealed flap for dispensing antimicrobial wipes, and a second container for disposing of the used wipes. A door sanitation kit similar to Arians is disclosed in U.S. Pat. No. 6,508,383 issued to Lidahl et al. except that a wet towel is dispensed for covering the hand prior to grabbing the handle to open a public bathroom door. However, none of these dispenser units is portable. Likewise, in none of them is a wet wipe towelette visibly available in order to encourage a person to wash his or her hands.

Hence, all of these prior art "cleaning systems" are either located within a private, household environment, lack portability, or are sufficiently cumbersome to make it unlikely that a person would choose to carry them for use within a public forum for cleaning one's hands. Limited examples of cleaning stations positioned within public places exists. For example, U.S. Pat. No. 6,691,897 issued to Ashe features a pole stand for use in a public area to which is attached a wet wipe dispenser, an antimicrobial soap dispenser, and spray bottle, and a waste basket. The patent discloses that this apparatus can be used for dispensing free cleaning and sanitizing supplies to the public, and that an advertising display can be added to provide a benefit to the merchant who makes this sanitation station available to its customers. Nevertheless, such an arrangement looks relatively rickety and is subject to falling over or being accidentally tipped over. Moreover, the wet wipe dispenser, hand soap dispenser, spray bottle, and pole provide a number of surfaces that need to be kept clean so as not to detract from the sanitary appearance of such a "sanitizing stand." In a similar vein, the open waste basket is subject to overflowing and will show any other messy garbage that is dumped in it by a customer.

U.S. Pat. No. 7,222,747 issued to Savran discloses a portable, multi-function sanitation system. It constitutes a main body having multiple compartments for holding a variety of cleaning products like spray bottles of anti-bacterial disinfectant, paper towels, tissues, and pre-moistened anti-bacterial sheets. A built-in trash receptacle receives the used cleaning products. This patent explains that the system can be used in healthcare or physical fitness environments. However, it also teaches that the sanitizing system should "substantially restrict the access of the public to the cleaning supplies contained within the housing component" and "is intended to discourage the potential for cross-contamination by excessive handling of the individual dispensing components" by the public. Thus, Savran's sanitizing system clearly is used by custodians or other staff members to clean hard surfaces in a health care or exercise facility, instead of by members of the public for cleaning their hands.

Therefore, there is a need for a self-contained, integrated hand and surface sanitizing wipe dispensing system that can be located inside restaurants, cafeterias, diaper changing stations, ballparks, casinos, petting zoos, kitchens, restrooms, and any other public or work areas where good hand hygiene is important, and soap and water are not readily available. The opportunity to grab a wet wipe to clean one's hands and quickly dispose of the wipe after use is convenient and may even remind the person to clean his or her hands. Good hand hygiene does not take much time or effort when it is convenient, and it offers great benefits in terms of preventing illness and the spread of infectious diseases.

SUMMARY OF THE INVENTION

An integrated, self-contained sanitizing wipe dispensing system is provided by the present invention. More specifically, the present invention provides for a mobile and self-contained sanitizing wipe dispensing system that dispenses discreet sheets of sanitizing wipes for hand or surface sanitization. The system is configured to facilitate the consistent dispensing of individual wipes, preferably from a roll of perforated but attached wipes, such that each wipe is separated at the point of perforation and the leading edge of the following sheet for easy access of each successive wipe. Means are provided to dispense wipes from a wall that is incorporated into the system, a plurality of walls forming an enclosure. The enclosure functions as a storage device for its own wipe refills and provides an integrated receptacle for used wipes.

The foregoing and other features of the sanitizing wipe dispensing system of the present invention will be apparent from the detailed description that follows.

DETAILED DESCRIPTION

An integrated, self-contained sanitizing wipe dispensing system is provided by the present invention. It provides for a mobile and self-contained sanitizing wipe dispensing system that dispenses discreet sheets of sanitizing wipes for hand or surface sanitization. The system is configured to facilitate the consistent dispensing of individual wipes, preferably from a roll of perforated but attached wipes, such that each wipe is separated at the point of perforation and the leading edge of the following sheet for easy access of each successive wipe. Means are provided to dispense wipes from a wall that is incorporated into the system, a plurality of walls forming an enclosure. The enclosure functions as a storage device for its own wipe refills and provides an integrated receptacle for used wipes.

Figure 1:
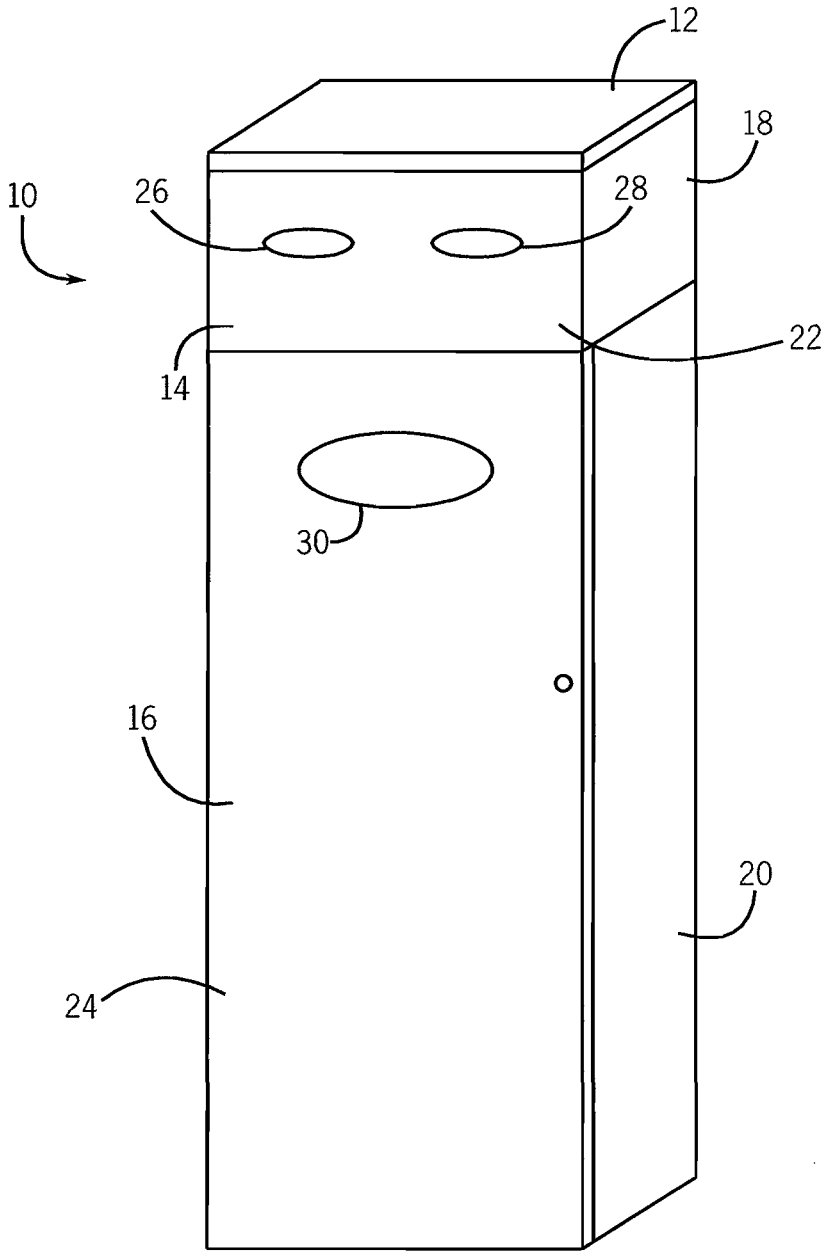
FIG. 1 is a perspective view of a first embodiment of the sanitizing wipe dispensing system of the present invention.

FIG. 1 shows one embodiment of the sanitizing wipe dispensing system 10 of the present invention. It contains a top wall 12, front upper wall 14, front lower wall 16, side upper wall 18, side lower wall 20, and corresponding walls on the other side and back. In this manner, the side walls cooperate with the top wall to form upper interior zone 22 and lower interior zone 24. Located on front upper panel 14 are two outlet openings 26 and 28 for dispensing sanitizing wet wipe towelettes, or simply "wet wipes" or "wipes," as will be discussed more fully below. Top wall 12 and front lower wall 16 are hinged by means of hinges 32 and 34, respectively, so that they can be easily opened to gain access to the upper interior zone 22 and lower interior zone 24.

The wet wipes for use in the sanitizing wipe dispensing system of the present invention can be any of a number of disinfectant wipe products that are known in the art. They may be made from paper, cloth, or other fiber products, and come in discrete sheets or tear-away panels. Each sheet or panel should be impregnated with a cleaning solution that may constitute a soap, disinfectant, or germicide. Lotions, moisturizers, perfumes, scents, or other agents may be added to the wipe as well for the convenience of the user. The wipes should be robust enough to not disintegrate upon use, but may be designed to biodegrade over time after its use.

Figure 2:
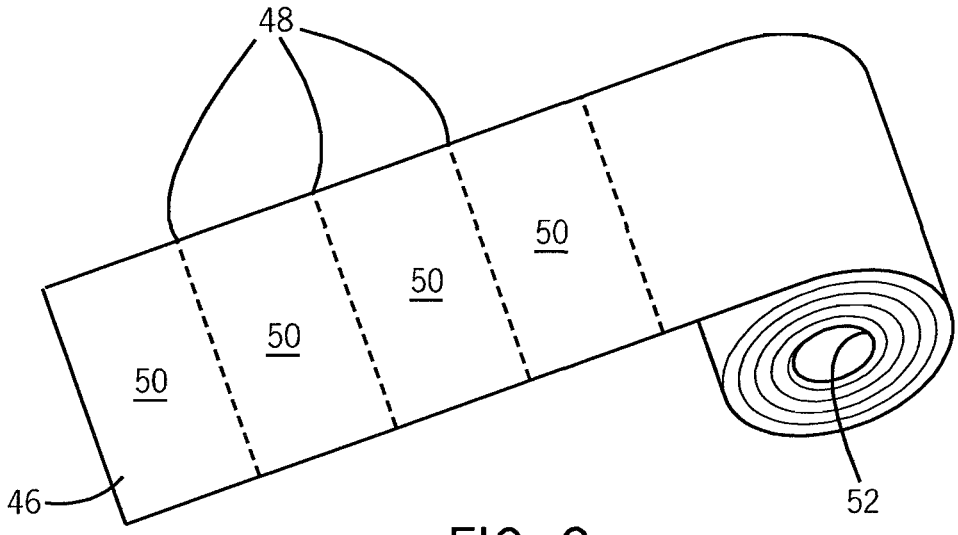
FIG. 2 is a perspective view of one embodiment of the roll of sanitizing wet wipes used in the sanitizing wipe dispensing system.
Figure 3:
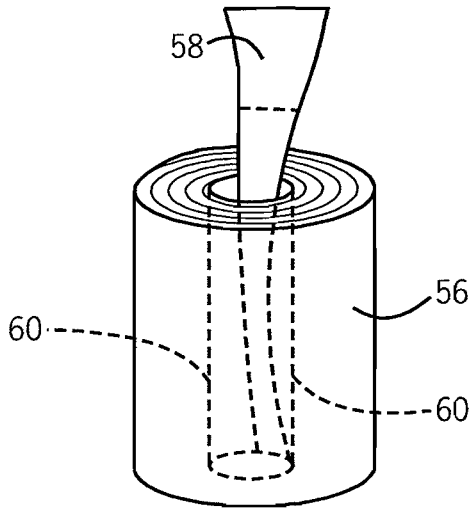
FIG. 3 is a perspective view of another embodiment of the roll of sanitizing wet wipes used in the sanitizing wipe dispensing system.

The wet wipes 50 will preferably consist of one long ribbon 46 of wipe sheets wound into a roll 52 with a multitude of serrated cuts 48 to form individual wipes 50, as shown more clearly in FIG. 2. The roll 56 may be wound so that pulling the first wipe will not only allow it to be separated from the roll 56 along the serration line, but also pull the next wipe into the standby position. The leading edge 58 is on the inside of the roll, as shown more clearly in FIG. 3. Such an arrangement provides more resistance to the wipes as they are pulled and separated from the roll, and contains the disinfecting solution impregnated within the wipes more completely in order to reduce evaporation.

Figure 4:
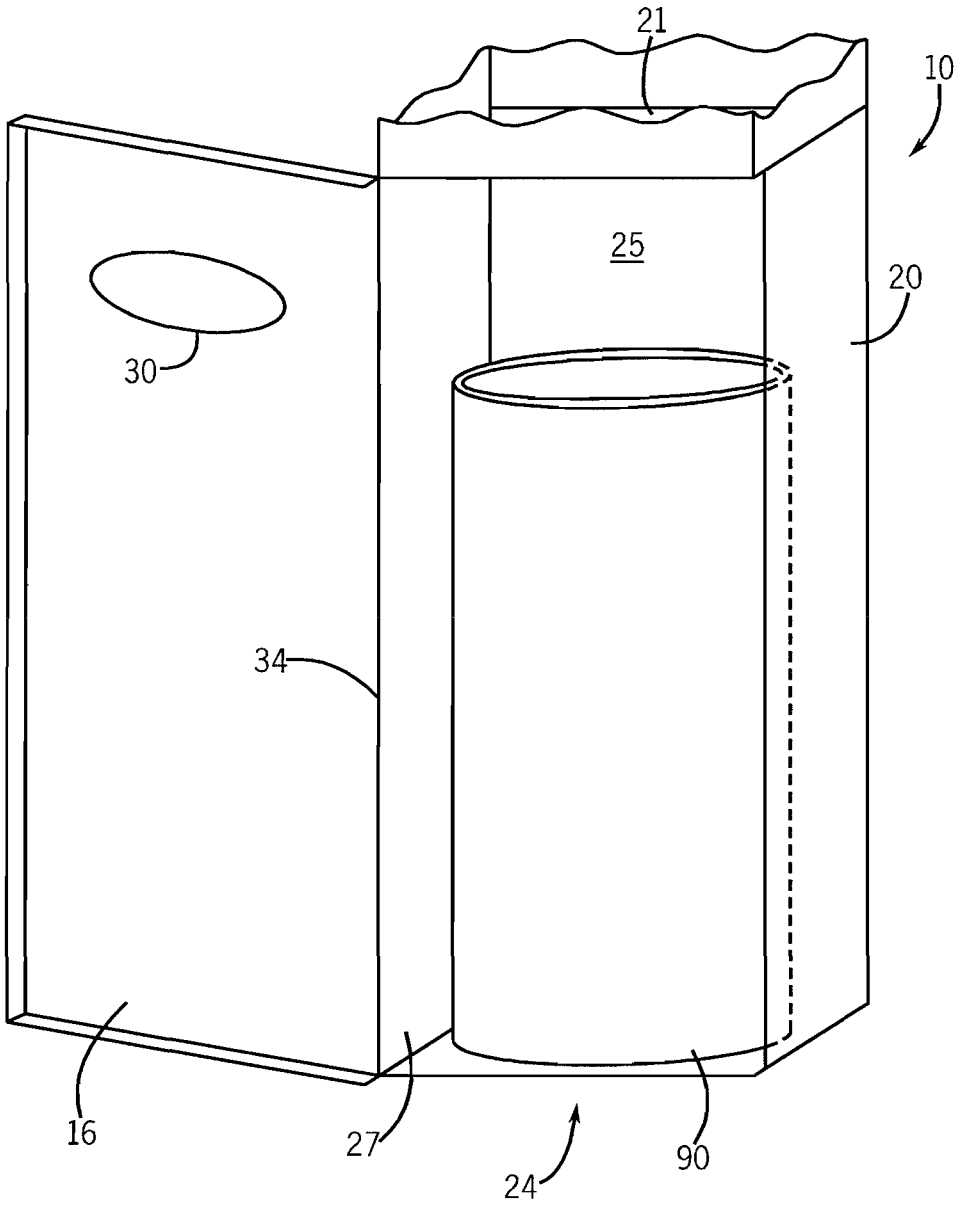
FIG. 4 is a perspective view of the lower portion of the sanitizing wipe dispensing system of FIG. 1, showing the trash receptacle installed therein.

FIG. 4 shows the lower portion of the sanitizing wipe dispensing system 10 of the present invention. As discussed above, front door panel 16, side walls 20 and 27, rear wall 25 and top wall 21 cooperate to form lower interior zone 24. Used wet wipes are inserted through inlet opening 30 in door panel 16 for convenient disposal. A trash receptacle 90 may be contained within lower zone 24 to collect used wipes for subsequent disposal. Door panel 16 is hinged on its one side with respect to wall 27 to enable the receptacle 90 to be placed into and taken out of the lower portion of the sanitizing wipe dispensing system for unloading. At the same time, the door, when closed, hides the receptacle 90 out of sight to provide a neater and more sanitary appearance of the sanitizing wipe dispensing system. While the wet wipes should not contain visible dirt or other mess after they are used to clean hands, a liner may still be used in the receptacle 90 in case other garbage is dumped by a customer into the sanitizing wipe dispensing system opening 30. The liner may also make it easier to dispose of the collected used wet wipes from the receptacle 90.

Figure 5:
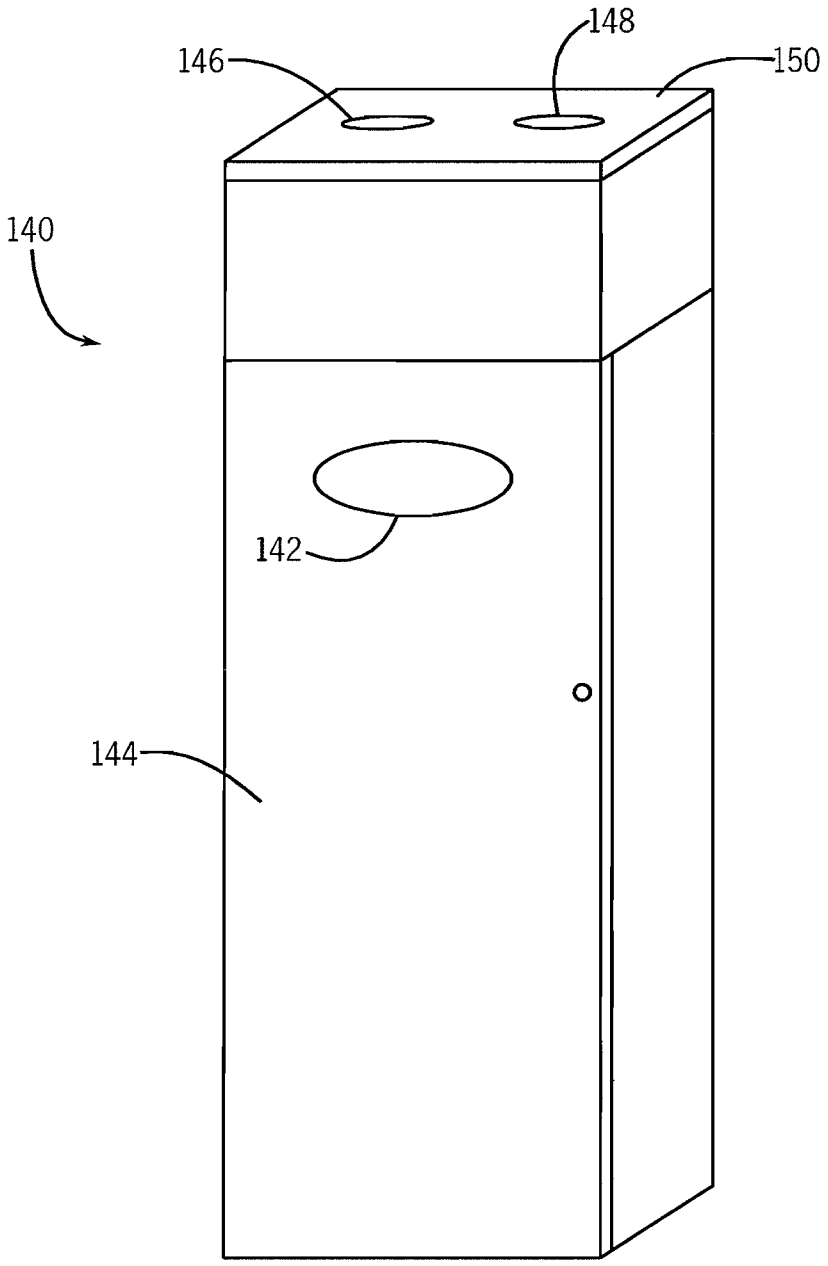
FIG. 5 is a perspective view of a second embodiment of the sanitizing wipe dispensing system of the present invention.

FIG. 5 shows another embodiment 140 of the sanitizing wipe dispensing system of the present invention. Like the embodiment shown in FIG. 1, the insertion hole 142 for disposal of the used wet wipes is in the front panel 144 of the lower portion. However, unlike the FIG. 1 embodiment, the dispensing orifices 146 and 148 for dispensing of wet wipes are located in the top panel 150 of the sanitizing wipe dispensing system.

In application, the sanitizing wipe dispensing system of the present invention may be used in any public area where people have a need or desire to wash their hands or clean a surface, and soap and water are not readily accessible. Thus, as a customer enters a restaurant, he could grab a wet wipe to wash his hands and easily dispose of the wipe more quickly than going to the restroom to wash his hands at the sink. The sanitizing wipe dispensing system could alternatively be positioned nearby the condiment station in the restaurant which is the last place most customers visit just before they sit down to eat their meal. The sanitizing wipe dispensing system could likewise be positioned in school or corporate cafeterias, food courts, or sports stadiums. Other possibilities include, without limitation, gymnasiums and exercise facilities, nursing homes, daycare centers, diaper changing stations, schools, banks, casinos, airports, cruise ships, hospitals, pediatrician's waiting rooms, petting zoos, kennels, veterinary clinics, and other public places where germs may be present. The sanitizing wipe dispensing system could also be located in restaurant kitchens to encourage kitchen staff to clean their hands more frequently. Likewise, the sanitizing wipe dispensing system could be placed in restrooms or portable outdoor toilets, because customers are more likely to grab a wet wipe to wash their hands if they can do so quickly without needing to touch a dirty sink, faucet, or towel dispenser.

The embodiments of the sanitizing wipe dispensing system shown in FIGS. 1 and 5 may be constructed from any suitable material like plastic, wood, or metal. Preferably, such material should be durable and capable of being wiped down for purposes of sanitization. Depending upon the owner of the public environment within which the sanitizing wipe dispensing system is placed, wood might be selected for aesthetic purposes, stainless steel might be chosen for regulatory food safety purposes, or plastic might be used as a low-cost material. Therefore, the material from which the sanitizing wipe dispensing system in these first embodiments is constructed must appropriately accommodate a variety of possible considerations.

Figure 6:
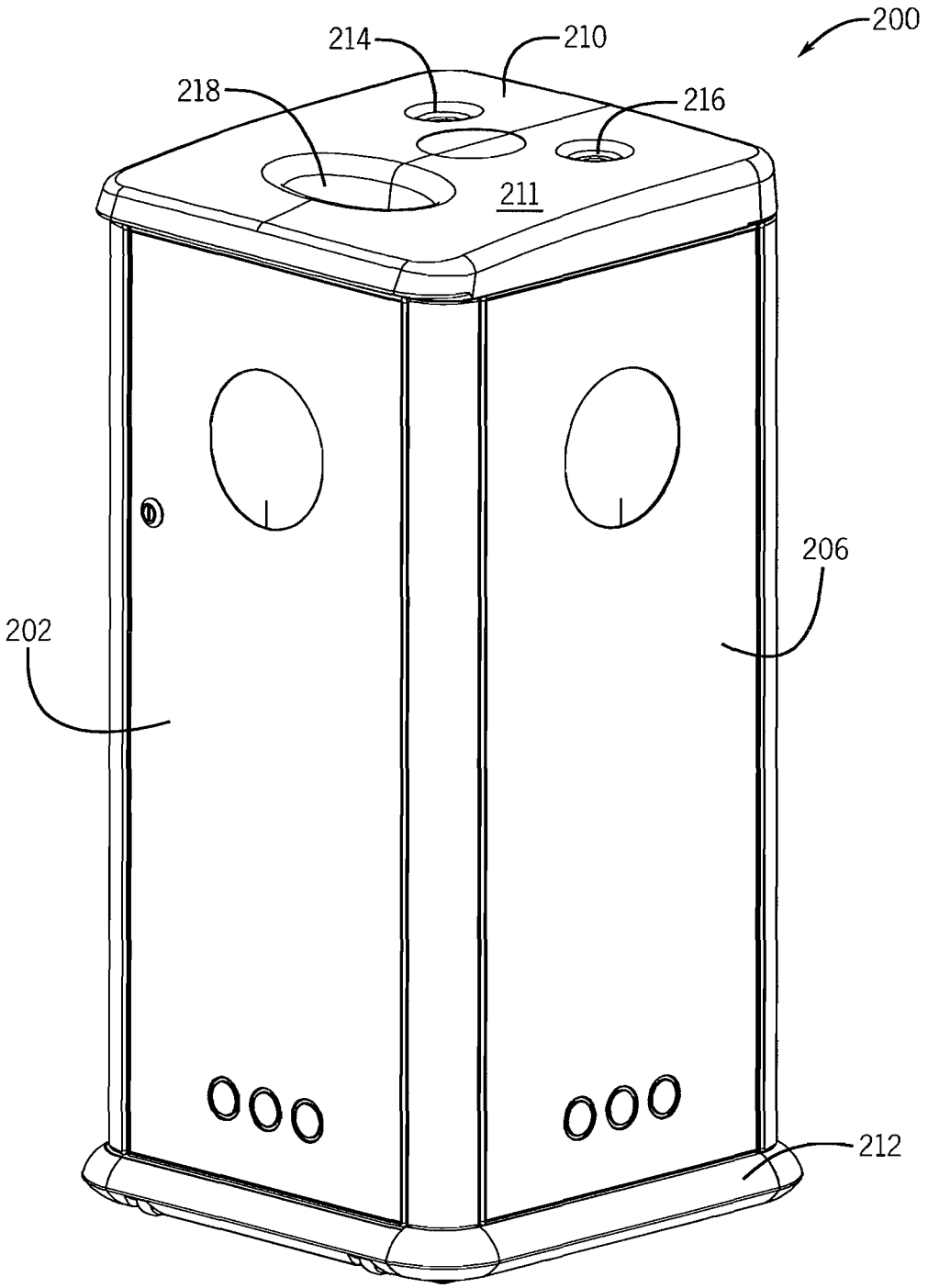
FIG. 6 is a perspective view of a third embodiment of the sanitizing wipe dispensing system of the present invention.

A further embodiment of a sanitizing wipe dispensing system 200 is depicted in FIG. 6. The design and structure of this particular embodiment is simple in structure. Many of its parts are made from blow-molded plastic, which is a relatively inexpensive material. The front, back, and side panels are identical in design, which reduces parts inventory and manufacturing costs. Moreover, the sanitizing wipe dispensing system 200 may be made from a recycled plastic material, which in combination with wet wipes that are formed from biodegradable material, addresses certain environmental concerns.

Figure 7:
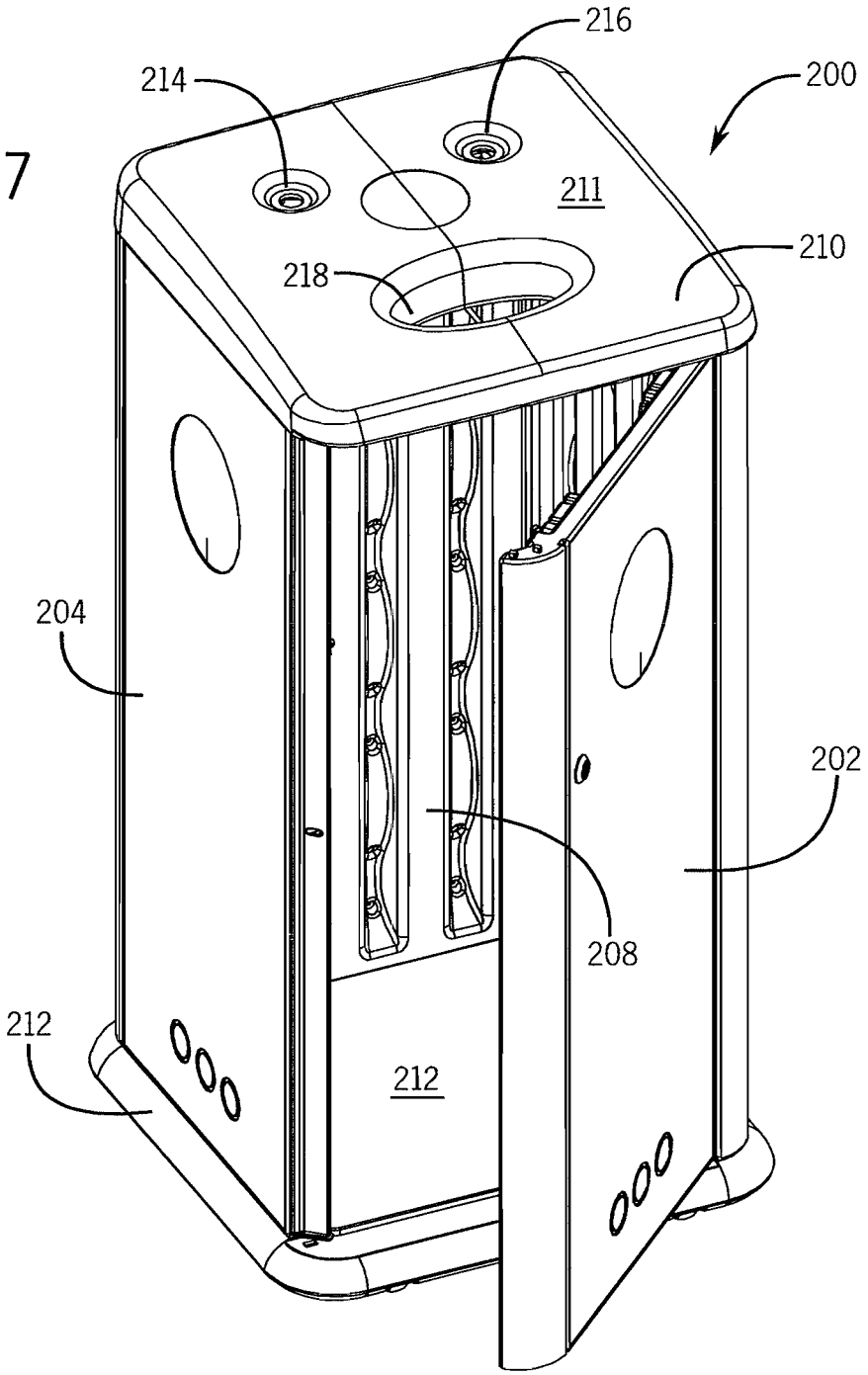
FIG. 7 is a perspective view of the sanitizing wipe dispensing system of FIG. 6, showing the front door panel partially opened.

Sanitizing wipe dispensing system 200 comprises a plurality of like-configured side panels 202, 204, 206, 208 and is depicted in FIG. 6 with its first side panel, or front door panel, 202 closed. In FIG. 7, the front door panel 202 is shown partially opened. In addition to the front door panel 202, the sanitizing wipe dispensing system 200 comprises second and third side panels 204, 206, respectively, and a fourth side panel, or back panel, 208, lid or top panel 210, and base panel 212. The system 200 is depicted as a square prism, although other shapes are possible. The principal advantage of the square prism shape is that side panels 204 and 206, back panel 208, and front door panel 202 may be designed and configured in an identical or substantially similar fashion for purposes of uniformity in application, ease of assembly and cost savings.

In the embodiment of sanitizing wipe dispensing system 200, top panel 210 contains dispensing orifices 214, 216 for accommodating the leading edge portion of a wet wipe sticking out of either orifice. Likewise, receiving orifice 218 in top panel 210 provides ready means for disposing of used wet wipe towelettes into a trash receptacle located inside the sanitizing wipe dispensing system 200, as will be discussed below. By locating wet wipe towelette dispensing orifices 214 and 216 and disposal receiving orifice 218 in the same top panel, as opposed to within a combination of top and front panels as shown by other embodiments in this invention, the side, front, and back panels may be produced identically without any need for a special panel containing a receiving or dispensing orifice.

Figure 8:
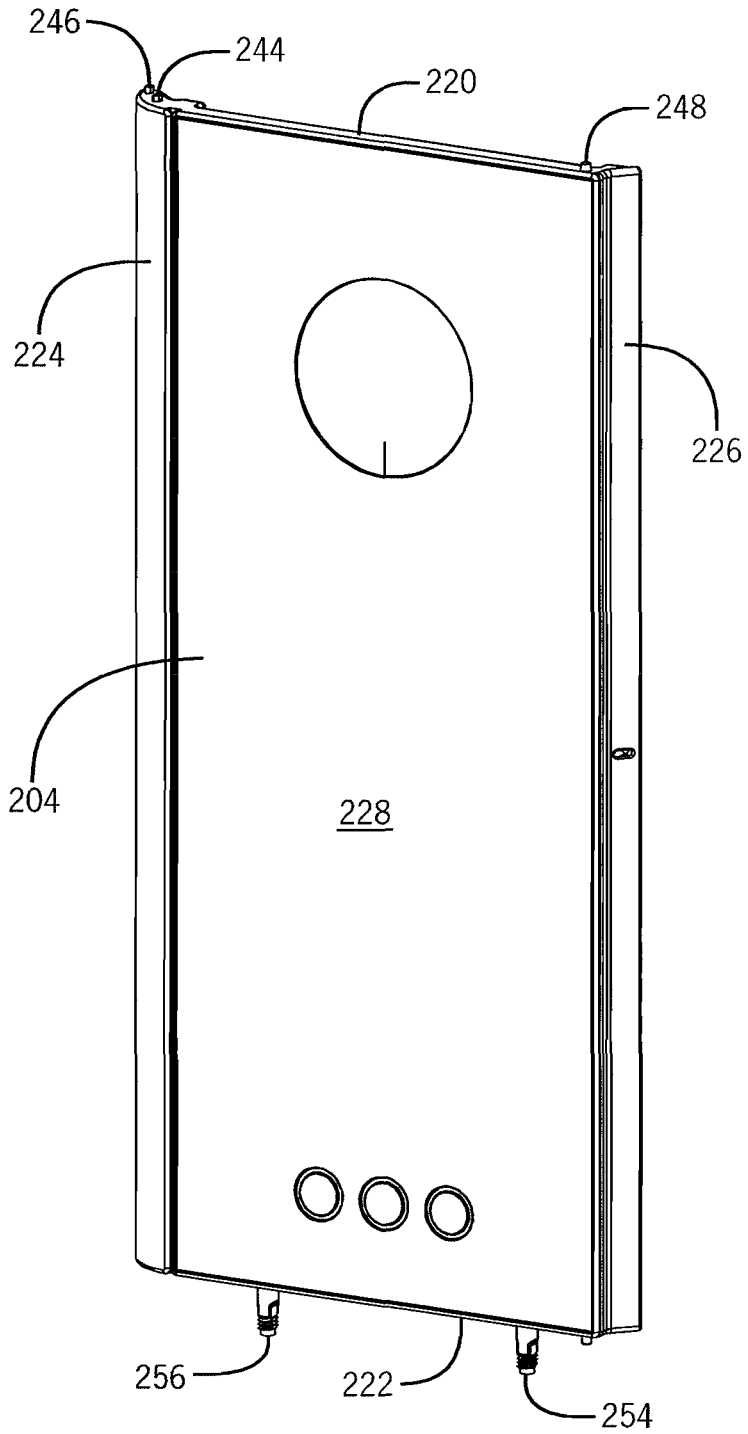
FIG. 8 is an exterior perspective view of a side panel of the sanitizing wipe dispensing system of FIG. 6.
Figure 9:
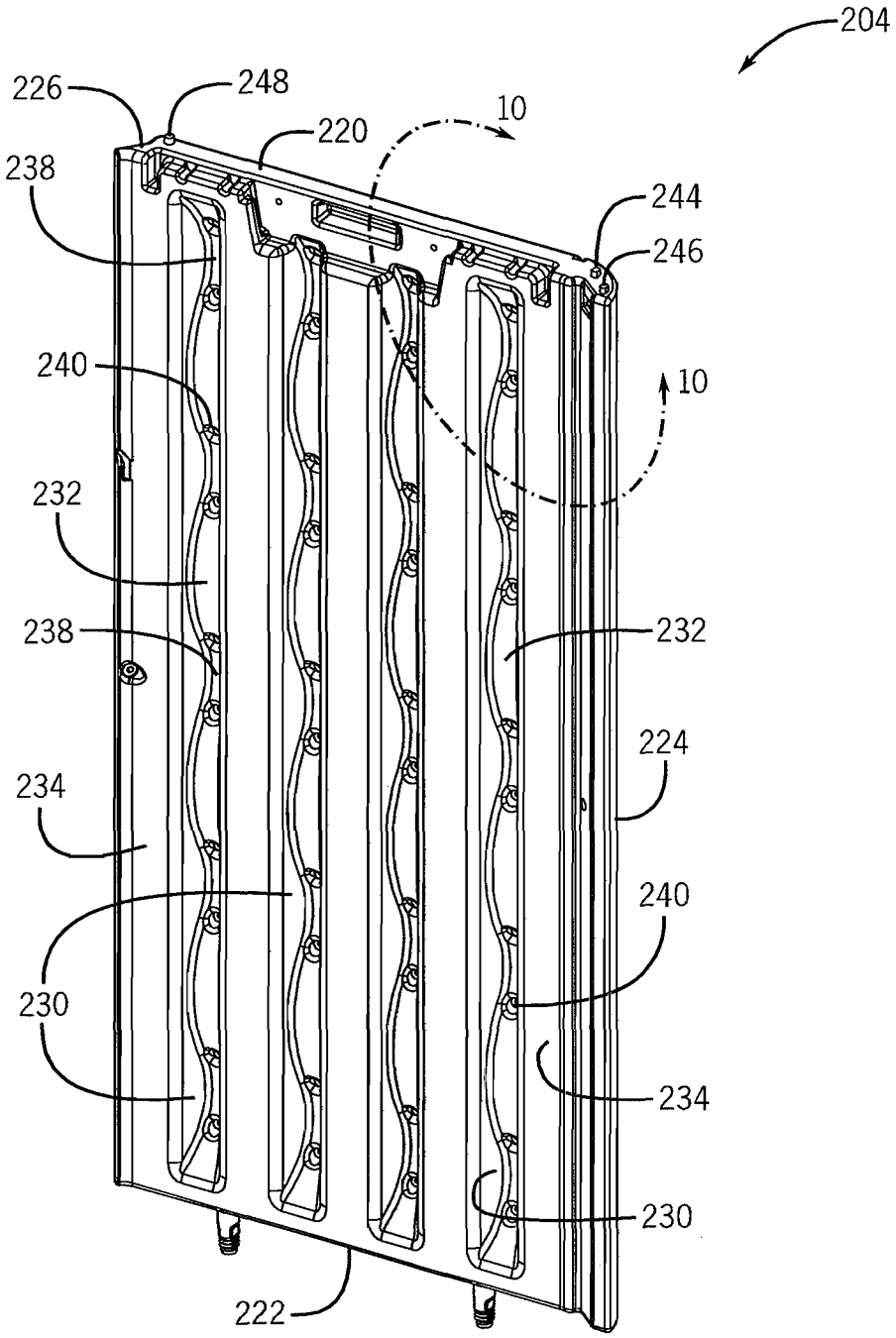
FIG. 9 is an interior perspective view of the side panel of FIG. 8.

A representative side panel 204 is shown in FIG. 8. This is an exterior view of the side panel containing a top edge 220, a bottom edge 222, a convex-shaped lateral edge 224 having an outwardly curved profile, and a concave-shaped lateral edge 226 having a complimentary inwardly curved profile. The interior surface of side panel 204 is depicted in FIG. 9. Molded within this interior surface are a plurality of vertically-oriented channels 230 ending in interior channel faces 232. As FIG. 9 illustrates, these interior channel faces 232 are sinusoidally shaped with respect to the flat interior surface 234 of the side panel. Because the panel is blow molded from plastic, it normally comprises a gap between this interior surface 234 and exterior surface 228 (see FIG. 8). This gap (not shown) would lead to flexing of the interior and outer surfaces, thereby causing weakness of the side panel. 204.

Blow-molding of plastic parts is well-known within the manufacturing industry. This process is widely employed to make bottles and other hollow objects. In this process, a tube of molten resin, called a "preform," is inserted into a mold. Compressed air or steam is then forced into the preform, which expands much like a balloon being inflated. This action forces the heated resin against the walls of the mold, where it is held until it hardens. The blow-molded part is then removed from the mold and cooled.

For purposes of this particular embodiment, a thermoplastic resin should be used. Thermoplastics are easier to handle than thermosetting plastics. Moreover, they require less time to set—as little as ten seconds—compared to as long as five minutes for thermoset plastics.

Portions 238 of the interior channel faces 232 along the vertical-oriented access channels 230 of side panel 204 minimize the size of the gaps between the interior and exterior panel surfaces. Moreover, at points 240, the interior channel faces 232 actually connect to the outer surface 228 of the side panel to form a series of "bridges" to lend structural integrity and resulting strength to the side panel 204. At the same time, these vertical channels 230 formed within the panel as part of the blow molding process are invisible along the flat exterior surface 228 of the panel 202.

Figure 10:
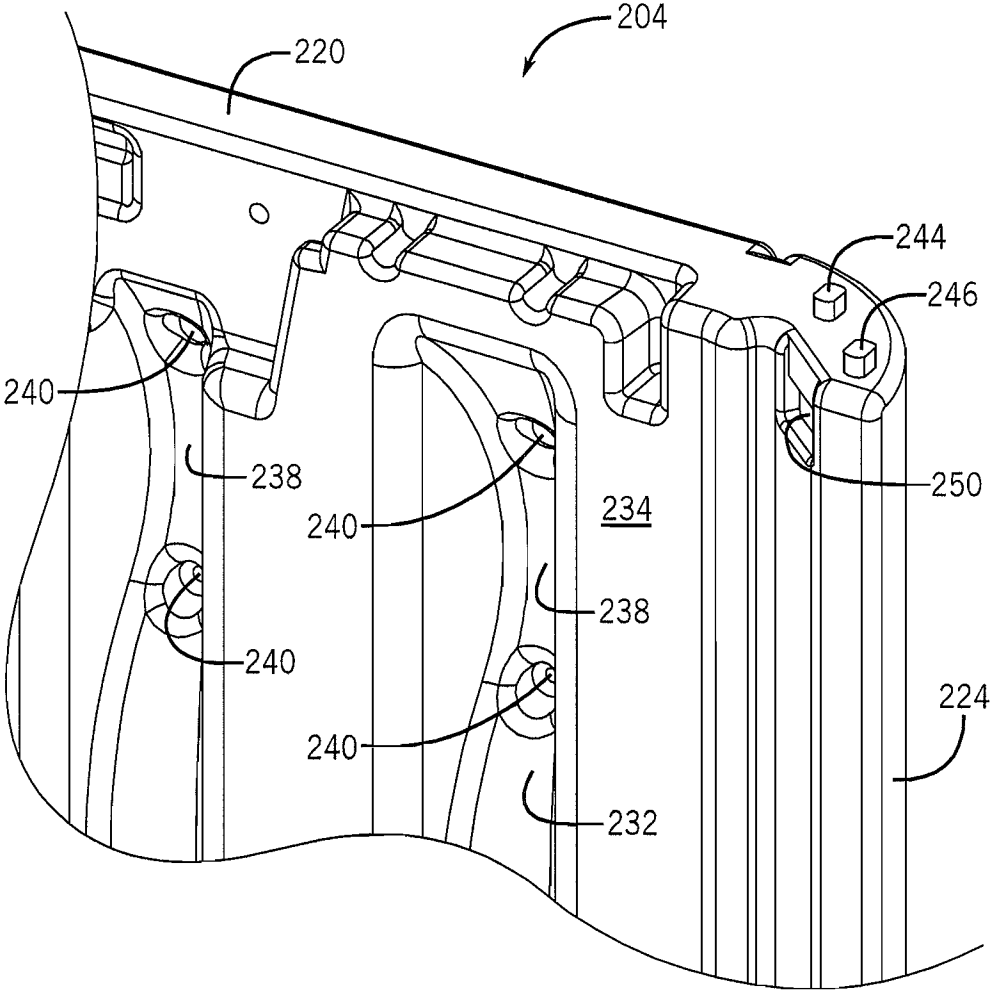
FIG. 10 is a detailed view of an upper portion of the side panel of FIG. 8.

Extending upwardly and vertically from top surface 220 of side panel 204 at the convex-shaped lateral edge 224 are posts 244 and 246. Extending vertically from the top surface near the concave-shaped lateral edge 226 is post 248. These posts 244, 246 and structural detail of the interior surface of side panel 204 are shown in greater detail in FIG. 10. Also formed within the interior surface of the convex-shaped lateral edge near its top surface 220 is recess 250, whose purpose will be explained below.

Figure 11:
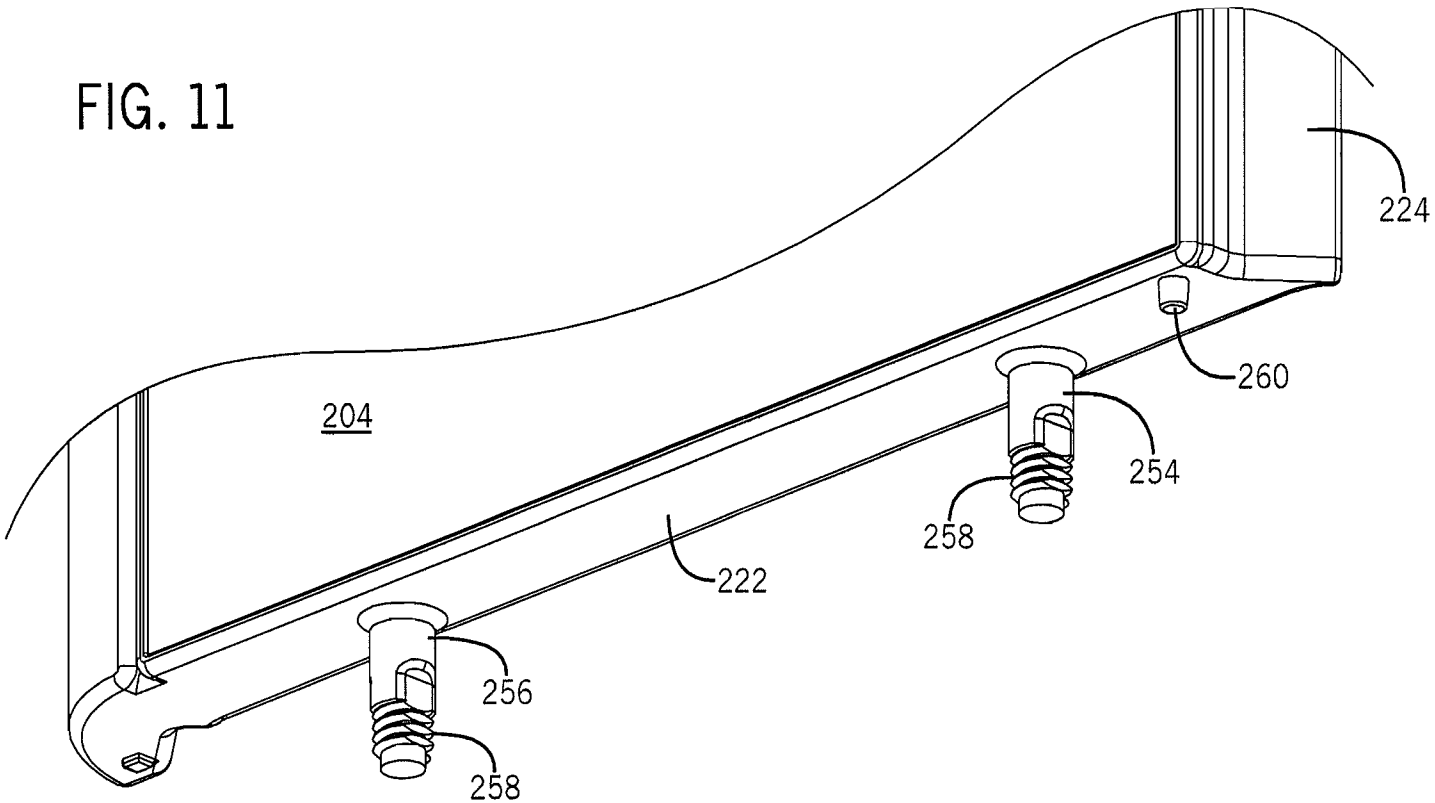
FIG. 11 is a detailed view of a lower portion of the side panel of FIG. 8.

Extending downwardly from bottom surface 222 of side panel 204, as shown in greater detail in FIG. 11, are threaded posts 254 and 256. These downwardly extending posts 254, 256 have helical threads 258 formed along their exterior surface. Also extending downwardly from bottom surface 222 near the concave-shaped lateral edge 224 is boss 260.

Again, one of the simplified structural aspects of this particular embodiment 200 of the sanitizing wipe dispensing system of the present invention is the fact that side panels 204, 206, back panel 208, and front/door panel 202 are alike. As shown in partial detail in FIG. 12, side panel 204 and rear panel 208 are fitted together in abutted alignment to form a 90° angle. The concave-shaped lateral edge 224 of side panel 204 extends into abutted engagement with the curved surface provided by concave-shaped lateral edge 262 of back panel 208. Meanwhile, corner bracket 264 forms a bridge between top surfaces 220 and 266 of side panel 204 and rear panel 208, respectively to secure these two panels together.

Figure 13:
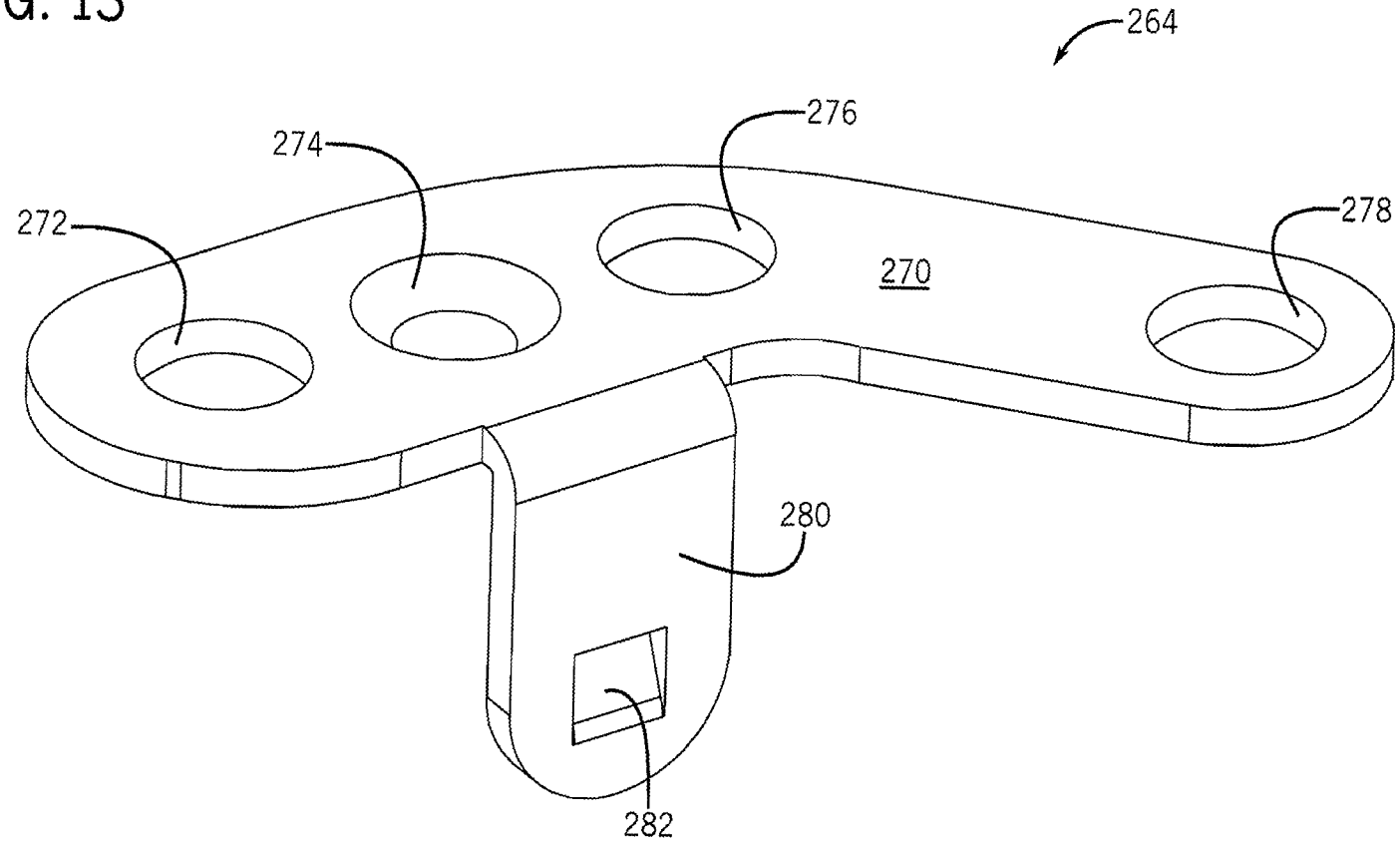
FIG. 13 is a perspective view of the corner bracket shown in FIG. 12.

Corner bracket 264 is shown in greater detail in FIG. 13. It is preferably made from a stamped zinc plate, although other appropriate metallic materials are possible, including aluminum.

The corner bracket 264 comprises a planar surface 270 in which are formed a plurality of holes 272, 274, 276, 278. Hole 274 should be countersunk. Tab 280 extends downwardly from planar surface 270, and features detent 282.

Figure 12:
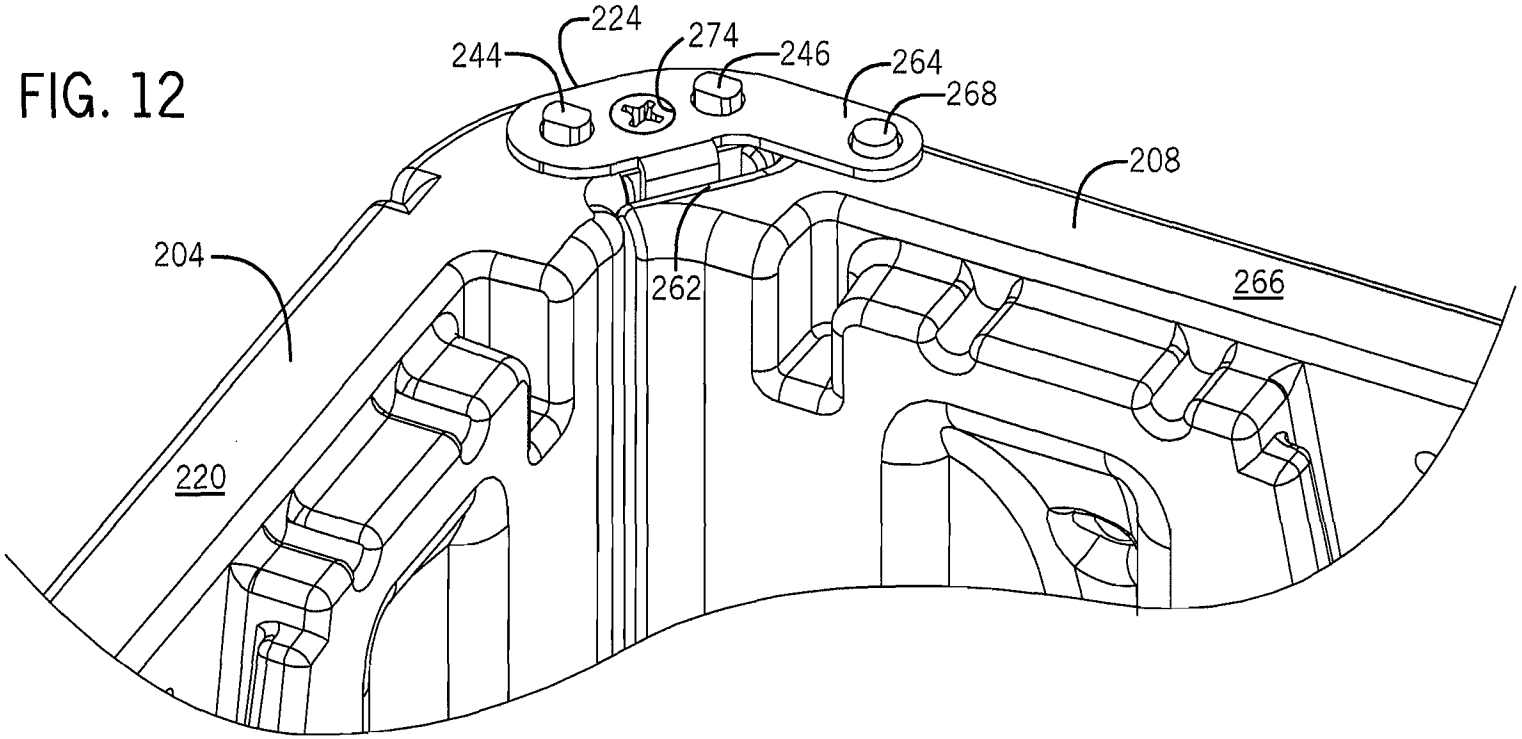
FIG. 12 is a perspective, partial view of a side panel and rear panel assembled together.

As illustrated in FIG. 12, holes 272 and 276 of corner bracket accept upwardly extending posts 244 and 246 of side panel 204. Hole 278 accepts the upwardly extending post of rear panel 208. Tab 280 fits between the interior surface of the concave-shaped lateral edge of side panel 204 and exterior surface of the convex-shaped lateral edge of rear panel 208 to lend support between these two panels. Detent 282 of corner bracket 264 extends into abutted engagement with recess 250 of side panel 204 shown in FIG. 10. If additional structural securement is desired, a screw or other fastener (not shown) can be driven through counter sunk hole 274 of corner bracket into the top surface 220 of side panel 204.

Corresponding corner brackets 264 help to join the top surfaces of the four panels together at the four corners of the sanitizing wipe dispensing system 200. The corner bracket joining side panel 206 and front/door panel 202 together serves the additional function of allowing the upwardly extending post corresponding to post 268 on rear panel 208 to rotate within hole 278 in corner bracket 264 to provide an effective upper hinge mechanism for door 202.

Figure 14:
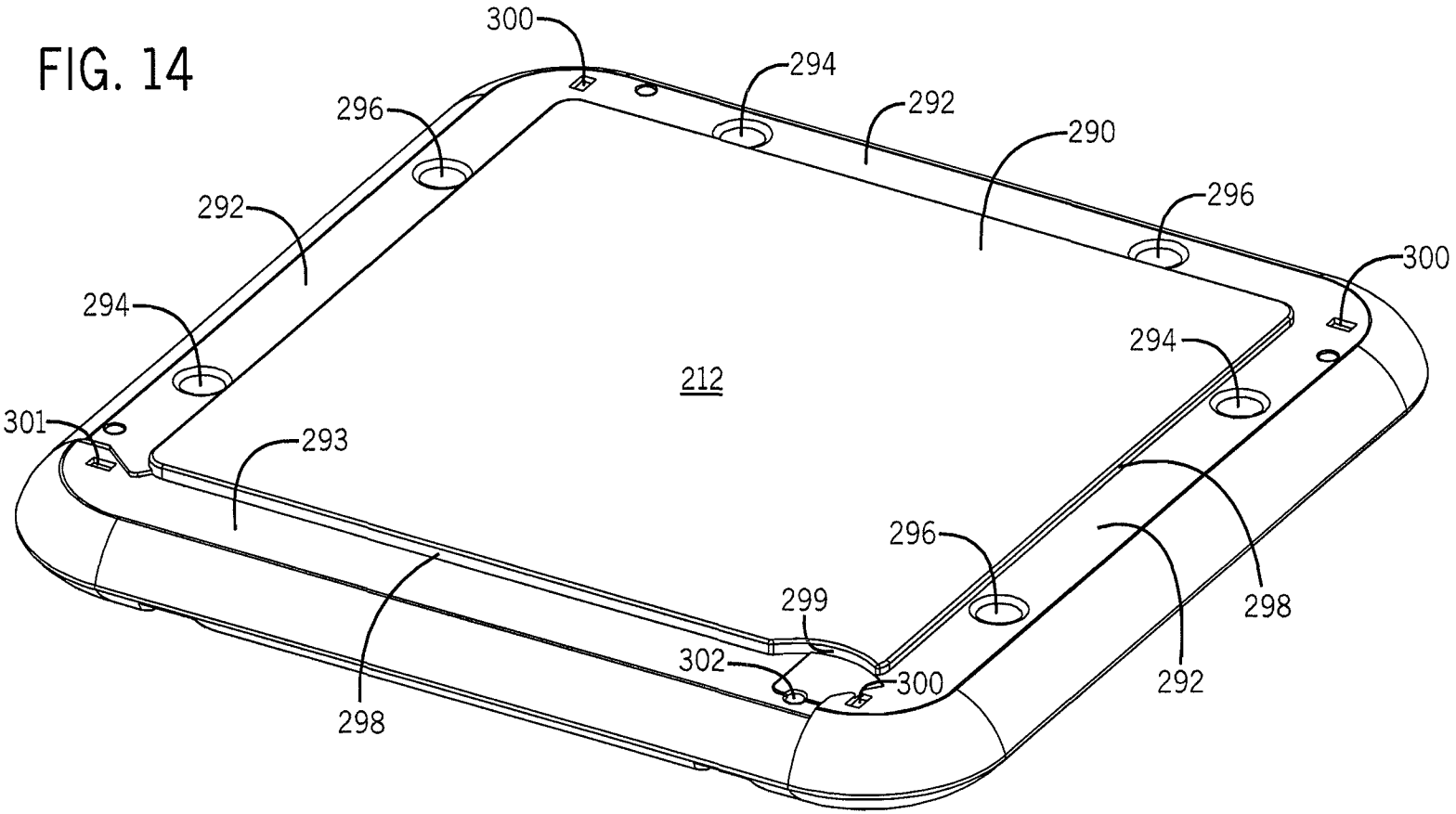
FIG. 14 is a perspective, top surface view of a base panel of the sanitizing wipe dispensing system of FIG. 6.
Figure 15:
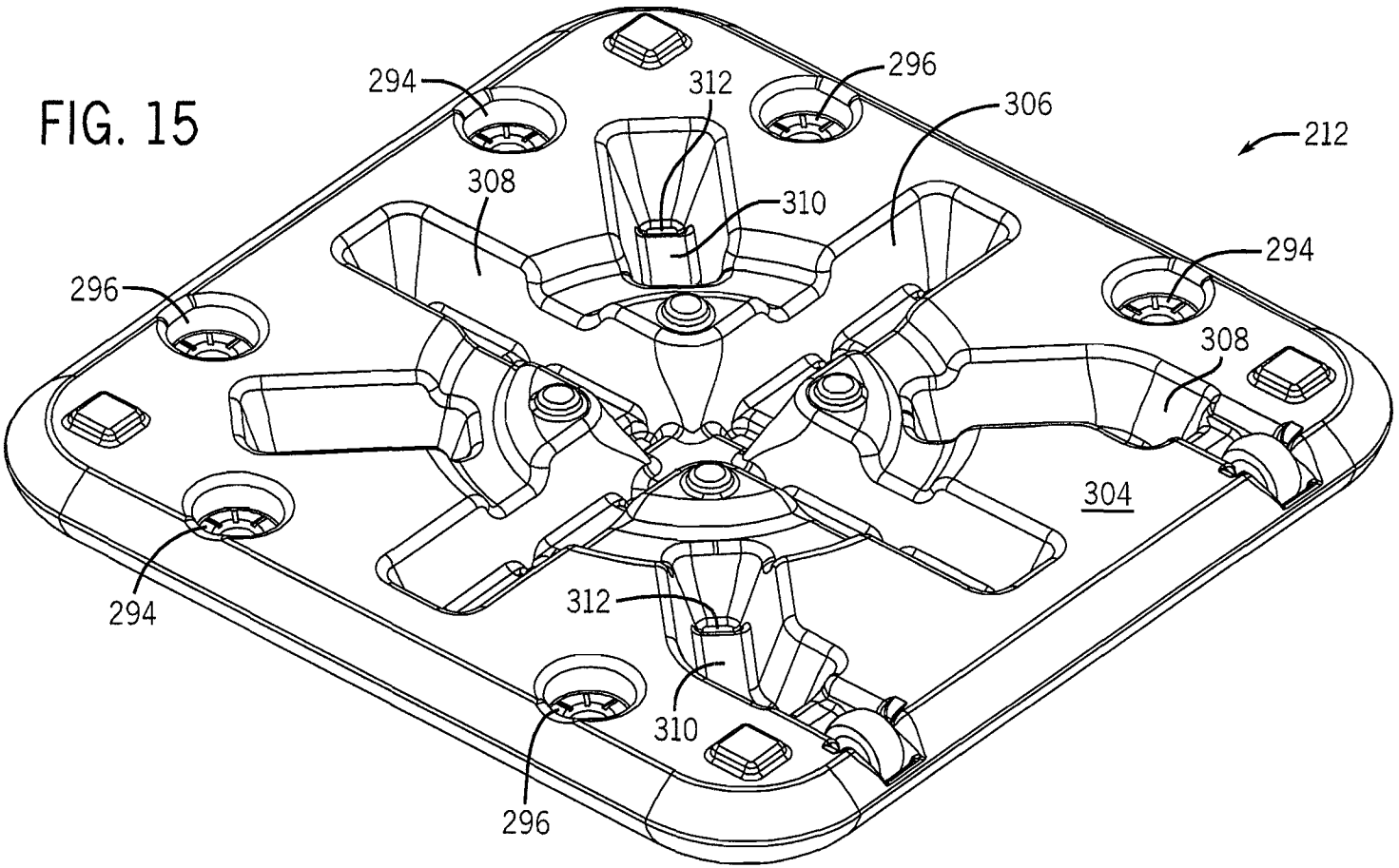
FIG. 15 is a perspective, bottom surface view of the base panel of FIG. 14.

Base panel 212 is shown in FIGS. 14 and 15. As depicted in FIG. 14, this base panel has a flat upper surface 290 that is raised slightly above perimeter flat surface 292 surrounding the four edges of the base panel 212. Formed within perimeter surface 292 corresponding to the side panels and rear panel sides of base panel are through holes 294 and 296. A vertical edge wall 298 connects top surface 290 and perimeter surface 292 around all four sides. Rectangular ramps 300 are formed within perimeter surface 292 near each corner. Holes 302 are also formed within the perimeter surface near each corner.

FIG. 15 shows the bottom surface 304 of base panel 212. Through holes 294 and 296 located along the side panels and rear panels are shown. Also illustrated is a substantial recess pattern 306 formed within the blow-molded base panel comprising channels 308, sinusoidally shaped channel faces 310 and bridge points 312 similar to that described above for the side, rear, and front panels. This recessed region 306 provides strength to base panel 212. This base panel can be blow-molded in the same manner and from the same material as the side, back, and door panels.

Figure 16:
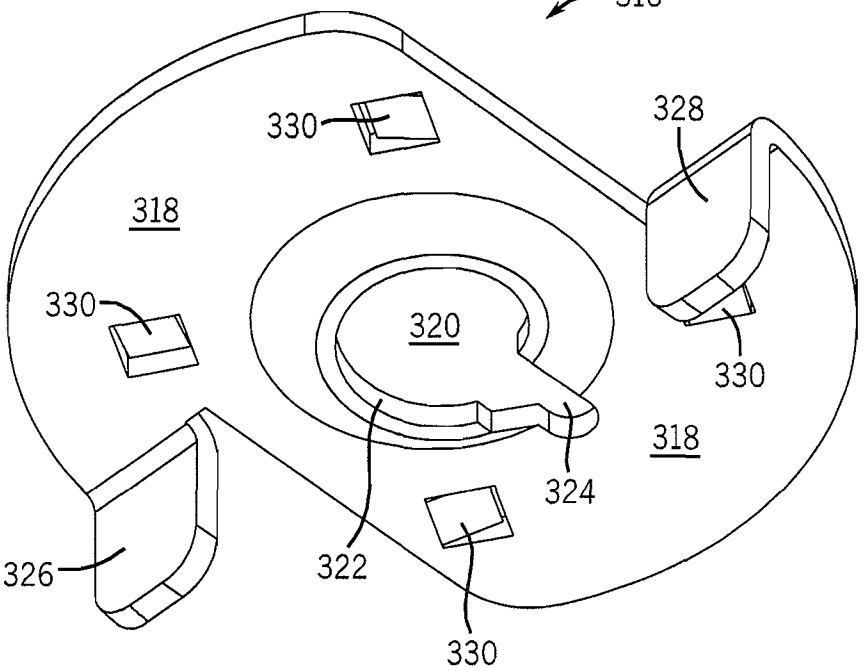
FIG. 16 is a perspective view of a wing nut for assembling a side panel or rear panel to the base panel.

A metal wing nut 316 is shown in FIG. 16. Like the corner brackets 264, it is preferably made from zinc plate although other appropriate metallic materials are possible, including aluminum.

This wing nut 316 comprises a planar region 318 with a through hole 320 stamped in its middle. This through hole features a helical edge 322. A notch 324 extends within planar surface 318 from the through hole 320. Arms 326 and 328 extend downwardly from planar surface 318 to provide finger turns for wing nut 316. Finally, ramps 330 extend upwardly from planar surface 318.

During assembly, downwardly extending threaded posts 254 and 256 of side panels 202 and 206, and rear panel 208 are extended through holes 294 and 296 in base panel 212 to form three sides of the sanitizing wipe dispensing system 200. Wing nuts 316 are inserted against the bottom surface of base panel 212 and around posts 294 and 296 that extend through the base panel. Helical edge 322 of the wing nut engages the threads 258 of posts 254, 256. Notch 324 allows flex of the spiral edge 322 as the wing nut 316 is rotated around the post. Once the wing nut abuts base panel 212, upwardly extending ramps 330 on the wing nut engage the plastic base bottom surface 304 to prevent counter-rotation of the wing nut with respect to the downwardly extending post 254, 256 of the panels.

Boss 260 extending downwardly from the side panels 204 and 206 and rear panel 208 engage holes 302 formed in base panel 212 for proper alignment of the side and rear panels with respect to the base panel. Vertical edge wall 298 abuts the bottom edge of side and rear panels to provide additional lateral support.

As shown in FIG. 14, door panel 202 is installed on top of perimeter top surface 293. The boss extending from the bottom of this door panel (corresponding to boss 260 in the FIG. 11 side panel 204) engages hole 302 to provide bottom rotational means for the door panel with respect to the base panel 212. Curved region 299 formed within the vertical edge 298 accommodate the swing of the convex-shaped lateral edge of the door panel 202. Vertical edge 298 acts as a door stop. Rectangular ramp 301 interacts with the bottom surface of the door panel to keep the door closed.

As shown in FIG. 6, sanitizing wipe dispensing system 200 has a lid or top panel 210 that overlays the top surface of side panels 204 and 206, rear panel 208, and front door panel 202. Lid or top panel 210 is formed from blow-molded plastic in the same fashion as the side, rear, front, and base panels. It has a top surface 211, which is depicted in FIG. 6 as sloped downwardly from the back to front edges. This downwards slope achieves several objectives. It makes that portion of the wet wipes sticking through the dispensing orifices 214, 216 more prominent with respect to the waste wipe receiving orifice 218. It also enables any beverage or other liquid that a customer spills on the lid or top panel 210 to roll off its surface without pooling.

Figure 17:
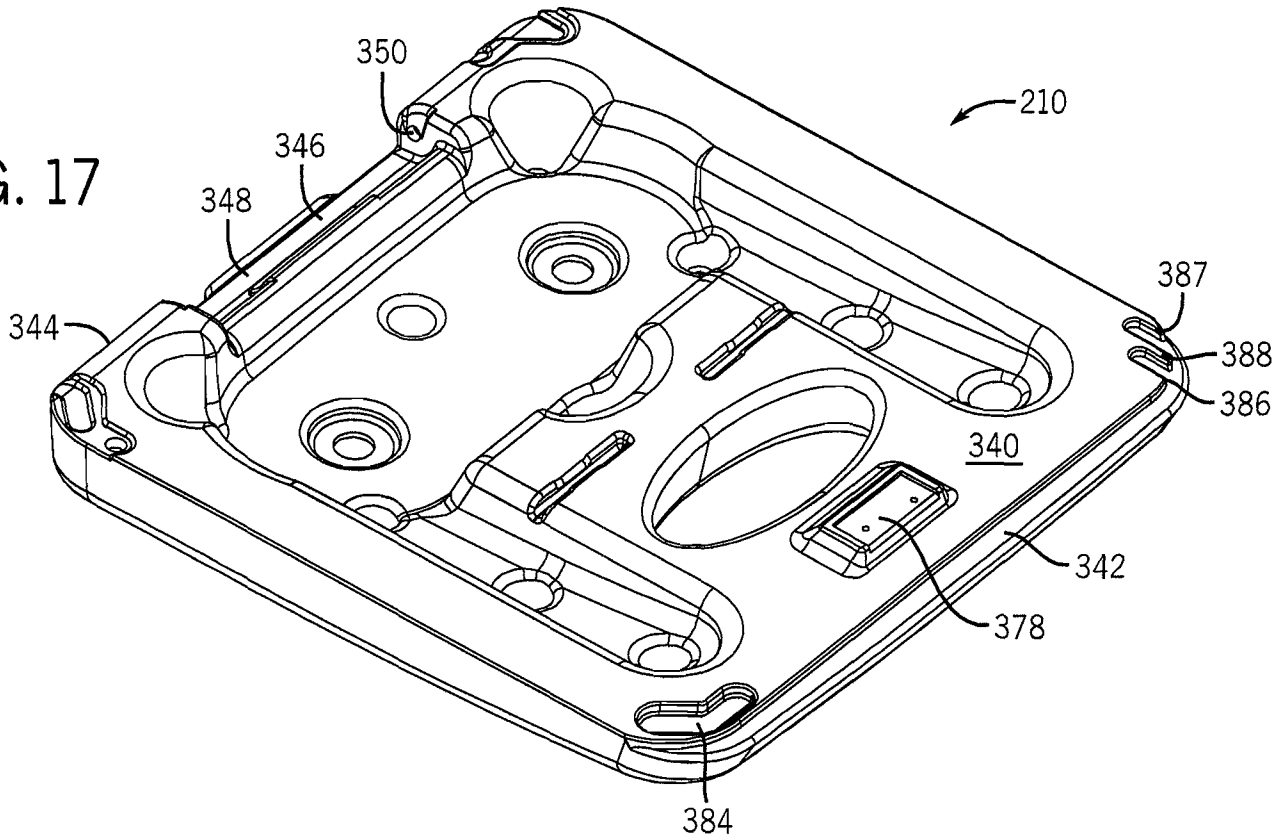
FIG. 17 is a perspective, bottom view of a top or lid panel of the sanitizing wipe dispensing system of FIG. 6.

The bottom surface 340 of lid or top panel 210 is shown in FIG. 17. It has a front edge 342 and a back edge 344. A horizontal cut-away region 346 is formed within the rear edge 344 defined by bearing surface 348 and side walls 350 and 352. Holes 354 and 356 are formed within side walls 350 and 352.

Figure 18:
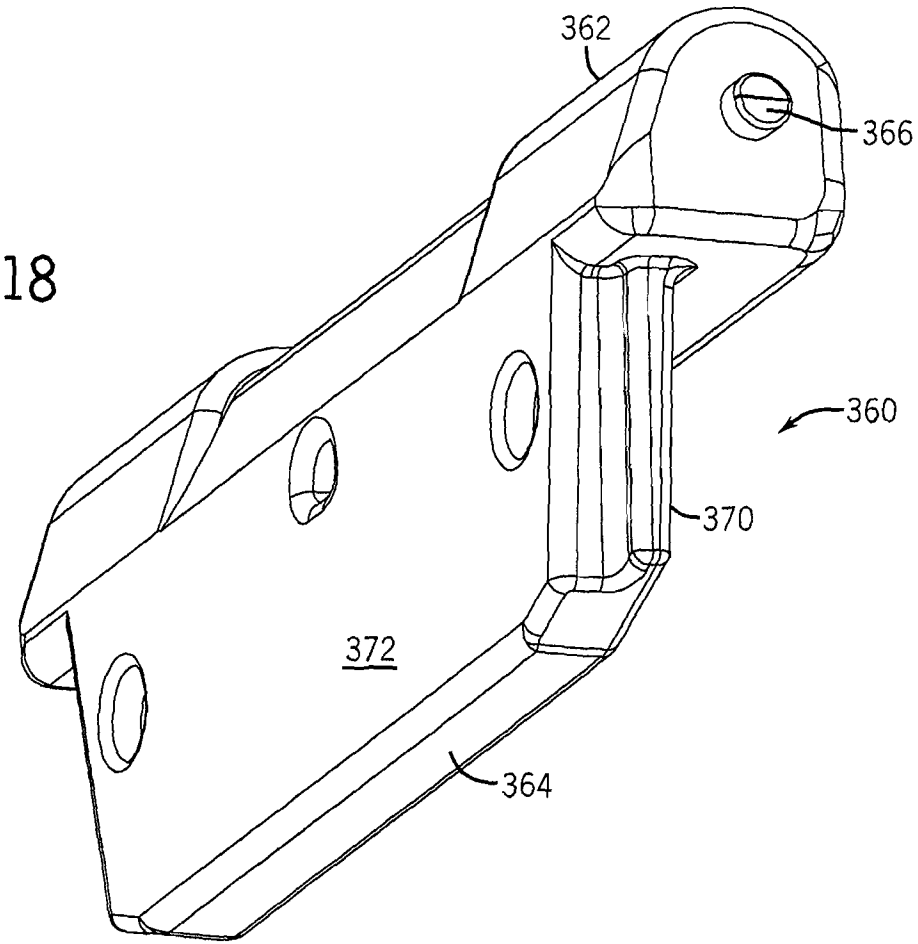
FIG. 18 is a perspective view of a hinge for assembling the top or lid panel to the rear panel of the sanitizing wipe dispensing system.
Figure 19:
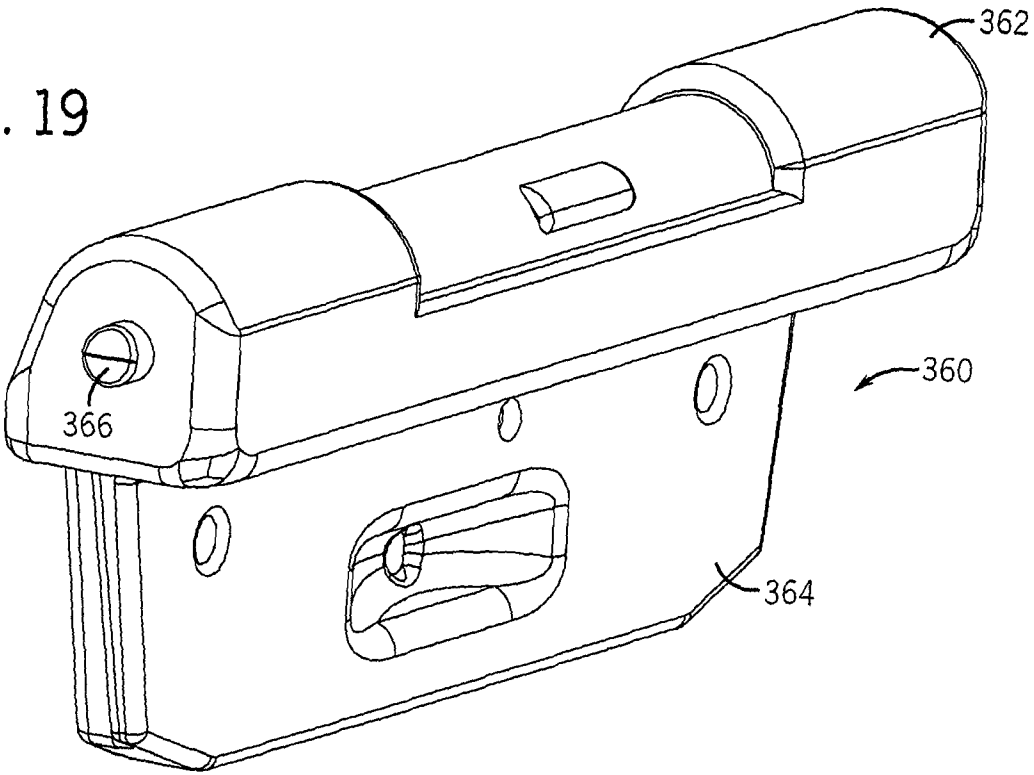
FIG. 19 is a perspective view of the opposite side of the hinge of FIG. 18.
Figure 20:
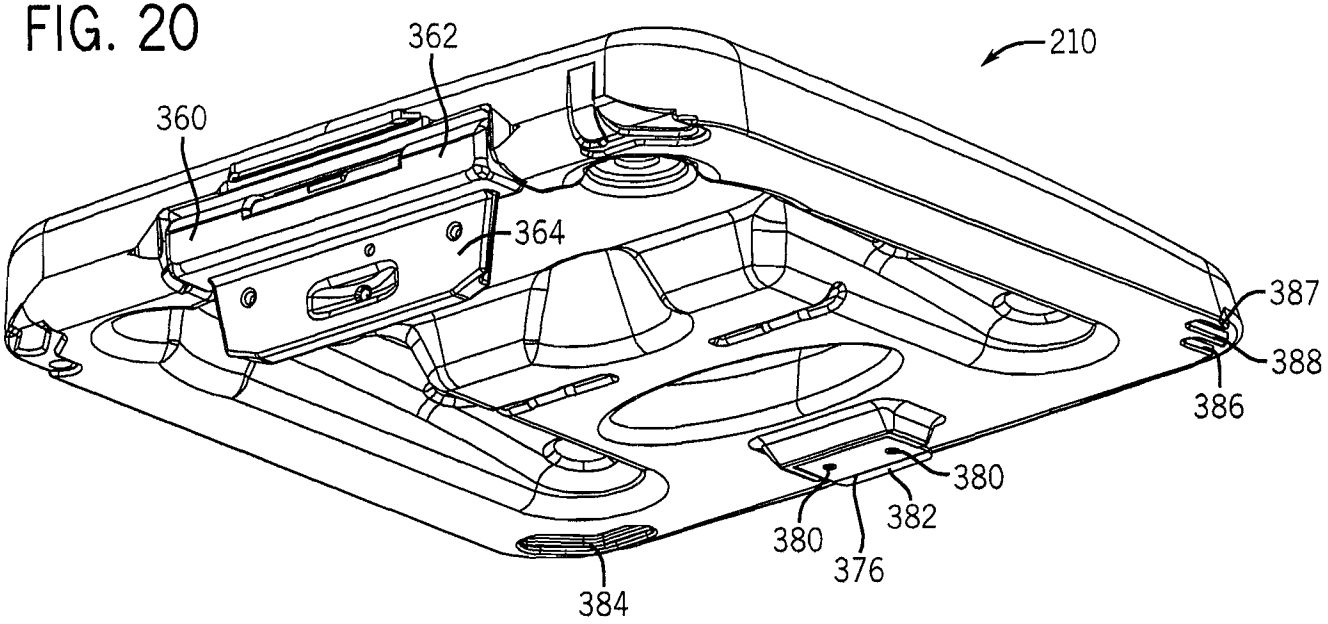
FIG. 20 is a perspective view of the top or lid panel of FIG. 17 with the hinge attached.

A plastic blow-molded hinge 360 is shown in greater detail in FIGS. 18 and 19. This hinge comprises a shoulder portion 362 and a downwardly extending tab portion 364. Posts 366 and 368 extend laterally from each end of shoulder 362. When the shoulder portion 362 of the hinge is inserted into cut-away region 346 of lid panel 210, as shown more clearly in FIG. 20, these hinge posts 366 and 318 snap into holes 352, 354 formed in the cut-away region side walls to cause the hinge to rotatably engage the lid panel 210. Preferably, an interference fit between the hinge posts and panel lid should be employed. Hinge 360 can be pressed into engagement with the lid panel during manufacture and while the lid panel is lightly or slightly hot to enhance this connection.

Surface 370 of hinge tab 364 is slightly tapered with respect to opposite surface 372. When this hinge tab 364 is inserted into recess 366 (not shown) in the top portion of back panel 208, this dovetail edge engages the recess, and provides a load-bearing edge as the lid panel is raised.

Lock tab 376 is secured to the bottom surface 340 of lid panel 210 within recess 378 by means of screws 380. This lock tab is preferably made from zinc plate as well. Lock tab 376 has a flanged edge 382. This flange engages a recess formed in the interior surface of the door panel when the lid is closed. This lock tab prevents the opening of lid panel 210 while door 202 is in the closed position.

Figure 21:
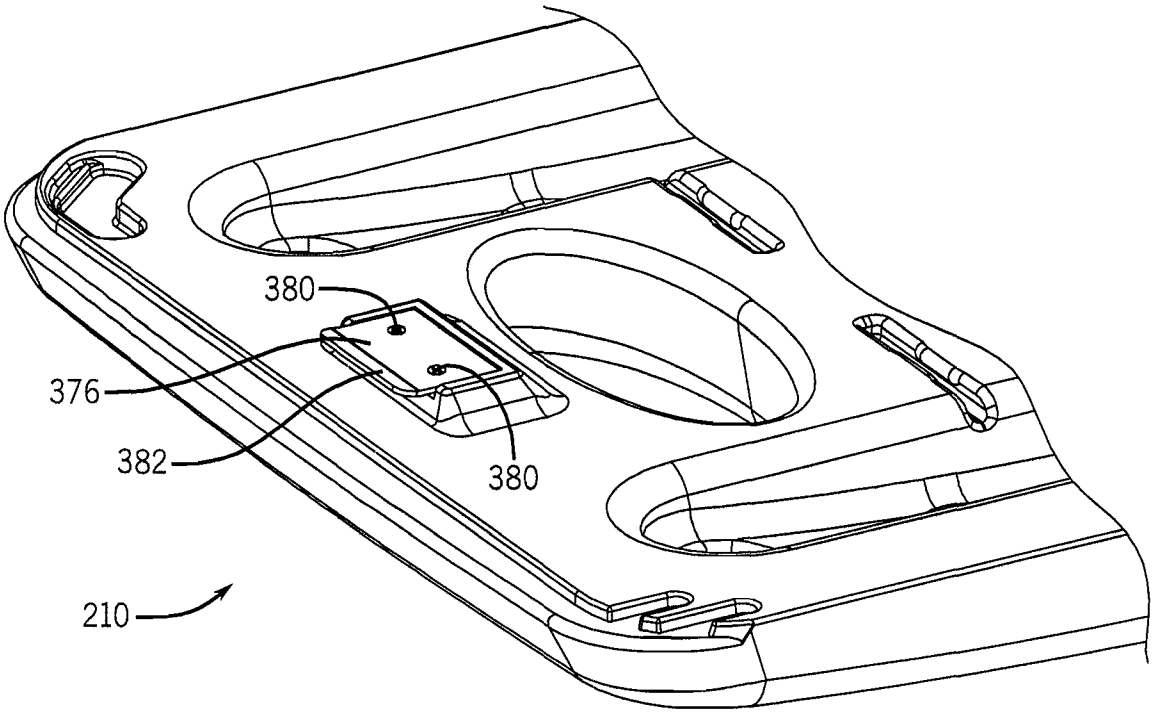
FIG. 21 is a perspective, partial view of the top or lid panel of FIG. 20 showing the lock flange plate.

As shown in FIGS. 17 and 21, the lid panel 210 features a kidney-shaped recess 384 and channels 386, 387 surrounding finger region 388 formed within the front corners of the bottom surface of the lid. Kidney recess 384 clears the corner bracket securing the side and door panels 204 and 202 together when the lid panel is closed. Channels 386 and 387 clear the upwardly extending posts 244 and 246 on the door panel when the lid panel is closed.

This lid panel 210 can be made in the same manner and from the same material that is used for the side, rear, door, and base panels. The range of motion of the opened lid panel can be 0-90°. Preferably, it should be a smaller angle like 45° to make it easier to thread the wet wipes' leading edge through the outlet opening 214, 216 without wasting wipes. A stop feature should be included to hold the lid panel in this open position while the wipe's leading edge is being installed through this dispensing orifice in the lid.

Figure 22:
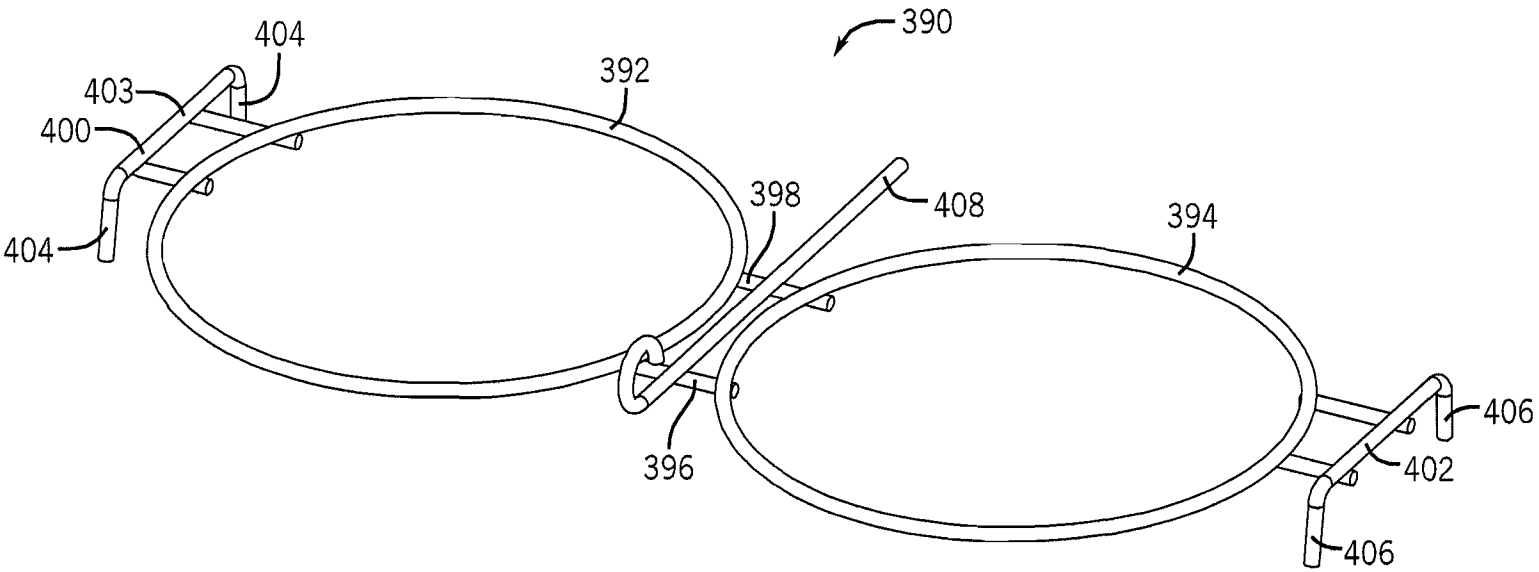
FIG. 22 is a perspective view of the wire basket assembly for the sanitizing wipe dispensing system of FIG. 6.

An important feature of the sanitizing wipe dispensing system embodiment 200 is the wire holder assembly 390 that is used to hold the wet wipes. This wire holder assembly is shown in greater detail in FIGS. 22 and 23. It comprises two rings 392 and 394 that are connected by means of cross bars 396 and 398. Extending from each ring is an arm extension 400 and 402 ending in downward finger extensions 404 and 406. Extending laterally from cross bars 396 and 398 and secured thereto is rear extension 408.

Figure 23:
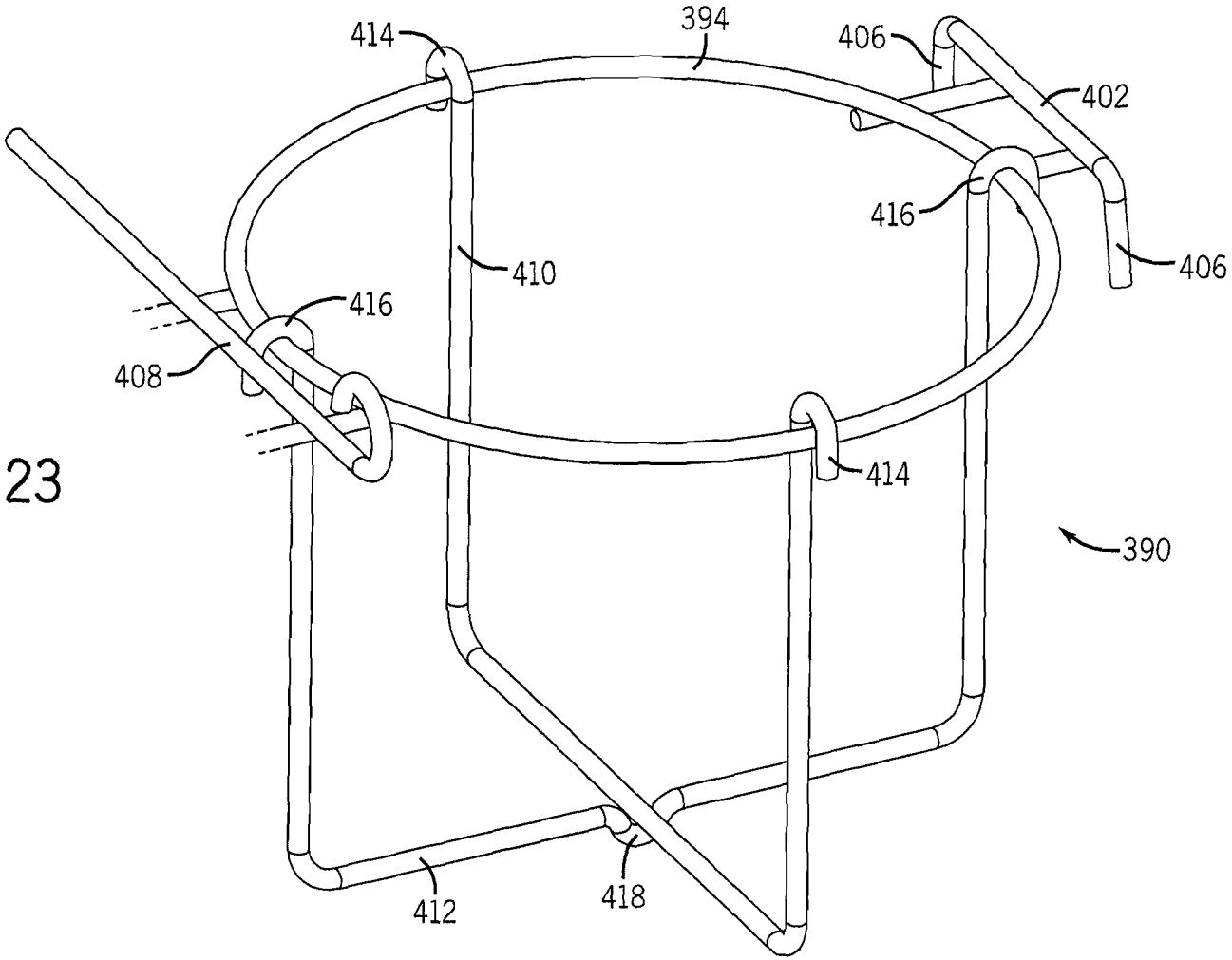
FIG. 23 is a perspective, partial view of the wire basket assembly of FIG. 22 fully assembled.

The ring portion 394 of wire holder assembly 390 is illustrated in FIG. 23. Hangers 410 and 412 are U-shaped with hooks 414 and 416 on each end. These hooks 414 and 416 secure the hangers 410 and 412 to ring 394. Hangers 410 and 412 are oriented in perpendicular relationship to each other with detent 418 in hanger 412 accommodating hanger 410.

In this manner ring 394 and hangers 410 and 412 cooperate to form a cup-shaped assembly for holding a roll of wet wipes. There is no need for a shelf in the sanitizing wipe dispensing system to hold the wet wipes, nor is there any need for a hard plastic packaging container, which is not biodegradable.

A roll of such wet wipes can easily hold 500 individual wipes. Given two rolls inserted in wire basket assembly 390, the resulting 1000 wipes will accommodate a number of customers in a public establishment, thereby reducing the frequency with which rolls need to be replaced in the sanitizing wipe dispensing system. The rolls can be simply packaged in a disposable polyethylene bag.

Figure 24:
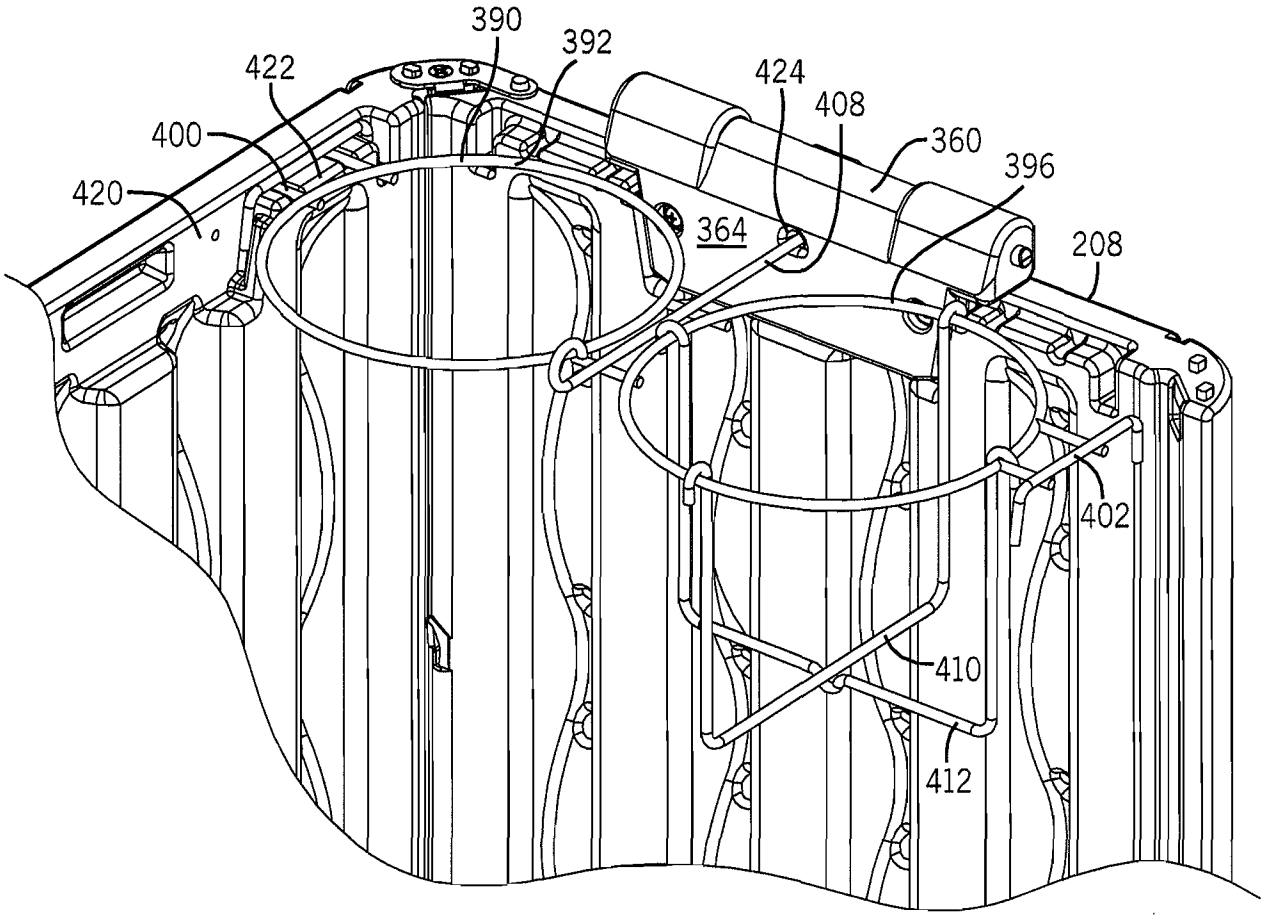
FIG. 24 is a perspective, partial view of the sanitizing wipe dispensing system of FIG. 6 with the wire basket assembly installed.

FIG. 24 shows the wire basket assembly 390 partially installed in the sanitizing wipe dispensing system. Extension area 400 engages recess 420 formed in side panel 204. Arms 404 and the central portion 403 of extension arm 400 surround and pressure fit against raised boss 422. A corresponding recess and boss formed in side panel 206 accommodates extension arm 402 on the other end of wire basket assembly 390. Rear extension 408 is inserted through hole 424 formed in hinge tab 364. In this manner, three sides of the wire basket assembly 390 are connected to three panels of the sanitizing wipe dispensing system 200. This wire basket assembly can easily bear the weight of two large rolls of wet wipes.

Figure 25:
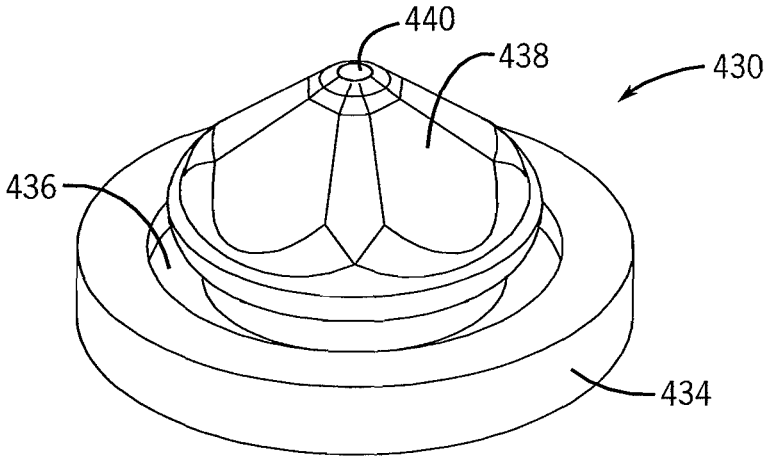
FIG. 25 is a perspective view of the nipple for the sanitizing wipe dispensing system of FIG. 6.
Figure 26:
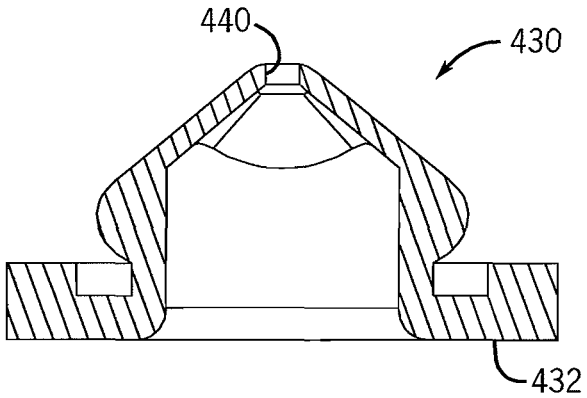
FIG. 26 is a perspective view of the bottom side of the nipple of FIG. 25.

A principal feature of the sanitizing wipe dispensing system embodiment 200 is the rubber nipples 430 depicted in FIGS. 25 and 26. Made from a flexible, but strong material like siliconized rubber that is resistant to cracking, they comprise a planar bottom surface 432 from which extends ring wall 434. Extending from the top surface 436 is a mushroom-shaped nipple portion 438. Located in the top of this nipple 438 is a nipple aperture 440. When the rubber nipple assembly is snap-fitted into a recess formed around the periphery of dispensing orifices 214, 216 in the top panel, the leading edge of a roll of wet wipes can be inserted through the nipple aperture 440 by use of a stylus that is not shown. In this manner, rubber nipple 430, as a part of the dispensing orifices 214, 216, facilitates consistent dispensing of discreet wipes and helps to keep the leading edge of the following wipe standing up for easy access by a customer. The nipple also protects the wet wipe from dirt and grime. Finally, it reduces the amount of air passage into the wet wipes roll, which could evaporate the sanitizer chemical impregnated into the wipes.

The interior volume of the sanitizing wipe dispensing system 200 is large enough that it can accommodate several storage boxes of additional rolls of wet wipes, which is key to the complete functionality of the sanitizing wipe dispensing system of the present invention. In front of these stacked boxes is placed a collapsible receptacle (not shown).

In application, the receptacle should be positioned inside the sanitizing wipe dispensing system directly below receiving orifice 218. Used wipes received through the orifice 218 in the lid panel 210 will fall directly into the receptacle. Ideally, the receptacle should extend in height nearly to the bottom of the top panel to reduce the chances of a received wipe falling outside the receptacle, but inside the system 200.

The plastic panels and other parts for this sanitizing wipe dispensing system can be fabricated from recycled materials. Colored recycled resins can be used. Coloring agents and other additives can be admixed into the resin prior to blow-molding.

The above specifications and drawings provide a complete description of the structure and use of the sanitizing wipe dispensing system of the present invention. It should be appreciated that many alternative embodiments of the invention can be made without departing from the spirit and scope of the invention. Therefore, the invention resides in the claims hereinafter appended.

I claim:

1. A sanitizing wipe dispensing system comprising:

four like-configured side panels, each side panel comprising a top edge, a bottom edge, a convex-shaped lateral edge having an outwardly curved profile, and a concave-shaped lateral edge having an inwardly curved profile, such inwardly curved profile being complementary to the outwardly curved profile of the concave-shaped lateral edge when adjacent panels are fitted together in abutted alignment to form a 90° angle;

a base panel, the base panel comprising four edges, a flat upper surface and a perimeter surface;

a top panel, the top panel comprising a bottom surface, a back edge, a bearing surface formed in the back edge and bearing surface side walls;

at least one post extending upwardly and vertically from the top edge at the convex-shaped lateral edge of each side panel, at least one post extending upwardly and vertically from the top edge at the concave-shaped lateral edge of each side panel, and a plurality of corner brackets, each corner bracket comprising a plurality of holes for accepting the upwardly extending posts of adjacent sidewalls therein and a fastener for fastening each bracket to a sidewall for fastening adjacent side panels together to form a portion of an enclosure and for hingedly fastening one of the side panels to an adjacent side panel to allow user access to the enclosure;

at least one post extending downwardly and vertically from the bottom edge of each side panel and a complementary hole located within the upper surface of the base panel at its perimeter surface for receiving the at least one post of each side panel for fastening one or more of the plurality of side panels to the base panel;

a hinge for hingedly fastening the top panel to one of the side panels to allow user access to the enclosure, the hinge permitting movement of the top panel from a closed position where the top panel overlays the top edges of the side panels and an open position;

at least one dispensing orifice defined in the top panel;

a basket-like wire structure comprising at least one wire ring disposed directly below the at least one dispensing orifice of the top panel when the top panel is in the closed position, a pair of U-shaped wire hooks hanging from the at least one wire ring and wire arm extensions with wire finger extensions for suspending the wire structure from the top edges of two opposing side panels and for suspending a roll of wipes within the enclosure and below the at least one dispensing orifice;

a receiving orifice defined in the top panel; and a receiving means disposed within the enclosure and below the receiving orifice.

2. The sanitizing wipe dispensing system of claim 1 wherein the at least one dispensing orifice comprises a pair of orifices and wherein the basket-like wire structure comprises a pair of rings, a pair of U-shaped wire hooks hanging from each wire ring and wire arm extensions with wire finger extensions wherein a roll of wipes is suspended below each orifice.

3. The sanitizing wipe dispensing system of claim 1 wherein the plurality of like configured side panels are each comprised of a blow-molded plastic material and each side panel further comprises an interior surface having a plurality of vertically-oriented and sinusoidally shaped channels ending in interior channel faces, an outer surface and a plurality of bridges connecting the interior channel faces to the outer surface of the side panel.

4. The sanitizing wipe dispensing system of claim 1 wherein the receiving means comprises a collapsible receptacle.

5. The sanitizing wipe dispensing system of claim 1 further comprising a plurality of wheels attached to the base panel wherein the dispenser is movable.

6. The sanitizing wipe dispensing system of claim 1 wherein the dispensing orifice further comprises a nipple and a nipple aperture and wherein individual wipes, preferably from a roll of perforated but attached wipes, are dispensed through the nipple aperture such that each wipe is separated at the point of perforation and the leading edge of the following sheet for easy access of each successive wipe.

7. The sanitizing wipe dispensing system of claim 1 where in the enclosure further comprises means for storing a plurality of wipe rolls therein.

8. The sanitizing wipe dispensing system of claim 1 wherein the at least one receiving orifice is alternatively defined in a sidewall.

* * * * *